US008292401B2

(12) United States Patent
Sasayama

(10) Patent No.: US 8,292,401 B2
(45) Date of Patent: Oct. 23, 2012

(54) IMAGE RECORDING APPARATUS AND IMAGE RECORDING METHOD

(75) Inventor: Hiroyuki Sasayama, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 217 days.

(21) Appl. No.: 12/893,625

(22) Filed: Sep. 29, 2010

(65) Prior Publication Data

US 2011/0074862 A1 Mar. 31, 2011

(30) Foreign Application Priority Data

Sep. 30, 2009 (JP) ..... 2009-227223

(51) Int. Cl.
*B41J 29/393* (2006.01)

(52) U.S. Cl. ..... 347/19; 347/13; 347/14

(58) Field of Classification Search ..... 347/19, 347/12–14
See application file for complete search history.

(56) References Cited

U.S. PATENT DOCUMENTS 7,085,002 B2 * 8/2006 Ilbery et al. ..... 358/1.8
7,537,305 B2 * 5/2009 Chiwata ..... 347/19
2003/0086100 A1 5/2003 Yashima et al.

FOREIGN PATENT DOCUMENTS

JP 2003-136764 A 5/2003

* cited by examiner

*Primary Examiner* — Julian Huffman
(74) *Attorney, Agent, or Firm* — Birch, Stewart, Kolasch & Birch, LLP

(57) ABSTRACT

An image recording apparatus includes: a recording head having a plurality of recording elements; a conveying device; a density information acquisition device; a characteristic computation device; a characteristic storage device; a comparison device which compares recording information with stored characteristic information; a density correction value calculation device which calculates a correction value for recording control according to the comparison result; a density correction value modification device which performs modification of the correction value; and an image correction device which corrects data of an image outputted by the plurality of recording elements according to the correction value calculated by the density correction value calculation device and the correction value modified by the density correction value modification device.

10 Claims, 14 Drawing Sheets

IMAGE RECORDING APPARATUS AND IMAGE RECORDING METHOD

BACKGROUND OF THE INVENTION

1. Field of the Invention

The present invention relates to an image recording apparatus and an image recording method, and more particularly to an image recording apparatus and an image recording method that correct density unevenness caused by variation in characteristics of recording elements when an image is recorded on a recording medium by using a recording head including a plurality of recording elements.

2. Description of the Related Art

In an image recording apparatus such as inkjet recording apparatus equipped with a plurality of nozzles, variation occurs in ejection characteristics among the nozzles with the passage of time because the ink dries in the nozzle opening, thereby producing deteriorated nozzles in which ejection of ink is adversely affected or non-ejecting nozzles that cannot eject the ink at all. The presence of such deteriorated nozzles and non-ejecting nozzles leads to permanent disturbance of recorded images, such as white streaks, and is therefore undesirable. Accordingly, Japanese Patent Application Publication No. 2003-136764 suggests a technique for preventing the disturbance of recorded image caused by deterioration of nozzle ejection capability.

Japanese Patent Application Publication No. 2003-136764 discloses an inkjet recording apparatus that records an image on a recording medium by ejecting ink from a plurality of nozzles. In such an inkjet recording apparatus, a pattern (shading pattern and non-ejection detection pattern) for measuring recording characteristics of a recording head is outputted, the density of the pattern is measured, and a non-ejecting nozzle that is in a non-ejection state is specified on the basis of the measurement results. Further, a density distribution corresponding to each nozzle is obtained and convolution integration using VTF (Visual Transfer Function) or PSF (Point Spread Function) is performed with respect to the density distribution. The result relating to the portion of the obtained density distribution that corresponds to the non-ejecting nozzle is compared with a reference set value that has been set in advance, and a complementary table for complementing with a color different from the color of the ink ejected by the non-ejecting nozzle is determined for each nozzle on the basis of the comparison results. Image data corresponding to the non-ejecting nozzle are converted into ink ejection information of different color that is ejected from another nozzle on the basis of the complementary table determined in the above-described manner.

Thus, with the technique disclosed in Japanese Patent Application Publication No. 2003-136764, non-ejection information is acquired on the basis of the recording pattern and complementary processing with an ink of different color is performed when a target nozzle is a non-ejecting nozzle. Where the target nozzle is not a non-ejecting nozzle, the amount of ink ejected from the target nozzle is adjusted, thereby performing a shading correction processing of correcting the density unevenness. With the technique disclosed in Japanese Patent Application Publication No. 2003-136764, it is possible to determine whether the non-ejection complementary processing or the shading correction processing is to be used, on the basis of the non-ejection information.

However, the range of levels of density unevenness caused by deterioration of nozzle ejection performance is wide, and in some cases, it is actually extremely difficult to cope with density unevenness by using only the usual shading correction processing with respect to deteriorated nozzles that have lost the capability of ejecting the original ink density (ink amount).

In particular, with the technique disclosed in Japanese Patent Application Publication No. 2003-136764, the usual shading correction processing is implemented even when the target nozzle is a nozzle (referred to hereinbelow as "abnormal density nozzle") that cannot eject ink of sufficient density even after the shading correction density but is not detected as a non-ejecting nozzle. However, density unevenness caused by the presence of such an abnormal density nozzle is not appropriately improved even by the density-increasing density processing (shading correction processing) that increases the amount of ink ejected from the abnormal density nozzle. As a result, the disturbance of image quality cannot be sufficiently prevented.

Furthermore, with the technique disclosed in Japanese Patent Application Publication No. 2003-136764, complementary processing of a non-ejecting nozzle is performed by inks of different colors. Therefore, the complementation ability is greatly affected by the types and number of inks of different colors that are used for the complementary processing. However, in the usual inkjet recording apparatus, a limitation is placed on the types and number of inks that can be used. As a result, the complementary processing of a non-ejecting nozzle sometimes cannot be sufficiently advanced. In addition, with the technique described in Japanese Patent Application Publication No. 2003-136764, shading data for the same color are also computed for the non-ejecting nozzle portion, but because of the non-ejection state, these data are actually not outputted and therefore the non-ejection complementation is performed by ink of different color.

SUMMARY OF THE INVENTION

The invention of the present application has been contrived with the foregoing in view and it is an object thereof to provide an image recording apparatus and an image recording method that can effectively reduce density unevenness of the recorded image caused by variation in ejection performance of recording elements.

In order to attain an object described above, one aspect of the present invention is directed to an image recording apparatus comprising: a recording head having a plurality of recording elements; a conveying device which conveys at least one of the recording head and a recording medium to cause relative movement between the recording head and the recording medium; a density information acquisition device which acquires output density data indicating a recording density of each of the plurality of recording elements; a characteristic computation device which obtains recording information of each of the plurality of recording elements from the output density data acquired by the density information acquisition device; a characteristic storage device which stores characteristic information in an appropriate state of the plurality of recording elements that is set in advance; a comparison device which compares, for each recording element that is able to perform recording on the recording medium, the recording information with the characteristic information stored in the characteristic storage device; a density correction value calculation device which calculates, for each of the plurality of recording elements, a correction value for recording control according to a comparison result of the recording information and the characteristic information obtained by the comparison device; a density correction value modification device which performs modification of the correction value for recording control of a peripheral recording element that performs recording on a periphery of a recording position on the recording medium performed by a detected recording element, from among the plurality of recording elements, for which the recording information is determined to fulfill a predetermined condition with respect to the characteristic information according to the comparison result, the modification being performed according to the characteristic information and the recording information of the detected recording element so as to compensate the recording density of the detected recording element; and an image correction device which performs, for each of the plurality of recording elements, correction of data of an image outputted by the plurality of recording elements onto the recording medium, according to the correction value calculated by the density correction value calculation device and the correction value modified by the density correction value modification device.

According to the present aspect, a correction value is calculated for each of the to recording elements on the basis of a comparison result of recording information indicating a recording density of a recording element and characteristic information in an appropriate state. Further, when a recording element (detected recording element) is present for which recording information fulfils a predetermined condition with respect to characteristic information on the basis of the comparison result, the correction value of a peripheral recording element present on the periphery of the detected recording element is modified and the correction value for recording control of the detected recording element is compensated. As a result, recording unevenness on the recording medium caused by the detected recording element can be eliminated by the modification of the correction value of the peripheral recording element.

The "recording elements" as referred to herein indicates the general unit that performs recording on the recording medium. In the case of an inkjet recording apparatus, a nozzle that can eject ink and an actuator (for example, a piezoelectric element or a heat-generating body) that imparts a propulsion force for ink ejection constitute a recording element. Further, the "characteristic information in an appropriate state" as referred to herein indicates characteristic information at the time the recording element operates appropriately, and the characteristic information in an appropriate state can be obtained by tests (e.g. experiments) or the like. The "recording element that can perform recording on the recording medium" generally indicates a recording element that can perform recording on the recording medium, even if the density is low, and a nozzle that cannot eject the ink at all (non-ejecting nozzle) is not included in the "recording element that can perform recording". The position of the "peripheral recording element" as referred to herein is based on the recording position on the recording medium and such an element is not necessarily disposed on the "periphery" in the recording head. Therefore, in the case of an inkjet recording apparatus, a nozzle that forms an ink dot disposed on the periphery (for example, adjacently) of an ink dot formed by the detected recording element on the recording medium is included in the peripheral recording elements (adjacent recording elements). Further, the "detected recording element" as referred to herein indicates a recording element that is the object of recording density compensation by recording control of the peripheral recording element. This is a general term that can include an abnormal density nozzle that performs recording only at a very low density and cannot eject ink of an appropriate amount even when the usual density correction is performed.

Desirably, the recording information and the characteristic information are based on input density data inputted to the plurality of recording elements and the output density data of the plurality of recording elements; and the comparison device compares, for each of the plurality of recording elements, the output density data with respect to the input density data of the recording information, to the output density data with respect to the input density data of the characteristic information.

In this aspect, the output density data of recording information and the output density data of characteristic information in an appropriate state are compared. Therefore, variation in recording performance (output density) with respect to the input density data can be clarified.

Desirably, a case in which the predetermined condition is determined to be fulfilled is a case in which it is determined that an appropriate recording density derived from the characteristic information cannot be outputted even if correction for the recording control is performed according to the recording information.

In this aspect, even when a detected recording element that cannot output the appropriate recording density despite the correction is included in the recording head, the recording performed by this detected recording element on the recording medium can be compensated and density unevenness can be effectively reduced by modifying the correction value for recording control of the peripheral recording element.

Desirably, a case in which the predetermined condition is determined to be fulfilled is a case in which the output density data of the recording information of the detected recording element do not exceed a predetermined critical density value that is established according to the characteristic information of the detected recording element.

Thus, by using the critical density value, it is possible to determine easily whether the target recording element is a detected recording element.

Desirably, the density correction value calculation device calculates, for each of the plurality of recording elements, the correction value according to a difference between the recording density indicated by the output density data of the characteristic information and the recording density indicated by the output density data of the recording information.

By calculating the difference between the output density in an appropriate state and an output density during actual recording as described above, it is possible to correct the output density of the recording element to the output density in an appropriate state, and deal adequately with the variation in ejection performance among the recording elements.

Desirably, the density correction value modification device modifies the correction value for recording control of the peripheral recording element according to a difference between the output density data of the detected recording element after the correction has been performed according to the correction value calculated by the density correction value calculation device, and the output density data of the characteristic information of the detected recording element.

By calculating the difference between the output density data of the detected recording element after the correction and the output density data in an appropriate state of the detected recording element as described above, it is possible to compensate the recording density corresponding to the deficiency in the output density of the detected recording element by the peripheral recording element.

Desirably, the peripheral recording elements records an image on the recording medium in opposing positions between which a position of the recording performed by the detected recording element is situated.

By using such peripheral recording elements, it is possible to sandwich the recording unevenness created by the detected recording element and conduct correction recording with the peripheral recording elements.

Desirably, the plurality of recording elements are disposed in the recording head in a range corresponding to entire width of a recording range of the recording medium.

When the recording head thus has the so-called line head structure, the recording unevenness caused by the above-described detected recording element can be easily revealed. Therefore, the above-described aspect of the present invention can demonstrate even better effect and the recording density unevenness can be effectively reduced.

Desirably, the recording head records an image on a predetermined recording range of the recording medium by one cycle of the relative movement.

When the recording head thus uses the so-called single pass system, the recording unevenness caused by variation in ejection performance among the recording elements can be easily revealed. Therefore, the above-described aspect of the present invention can demonstrate even better effect and the recording density unevenness can be effectively reduced.

In order to attain an object described above, one aspect of the present invention is directed to an image recording method controlling a plurality of recording elements to record an image, the image recording method comprising: a density information acquisition step of acquiring output density data indicating a recording density of each of the plurality of recording elements; a characteristic computation step of obtaining recording information of each of the plurality of recording elements from the output density data; a comparison step of performing, for each recording element that is able to perform recording on the recording medium, comparison of the recording information with characteristic information in an appropriate state of the plurality of recording elements that is set in advance; a density correction value calculation step of calculating, for each of the plurality of recording elements, a correction value for recording control according to result of the comparison of the recording information and the characteristic information; a density correction value modification step of performing modification of the correction value for recording control of a peripheral recording element that performs recording on a periphery of a recording position on the recording medium performed by a detected recording element, from among the plurality of recording elements, for which the recording information is determined to fulfill a predetermined condition with respect to the characteristic information according to the result of the comparison, the modification being performed according to the characteristic information and the recording information of the detected recording element so as to compensate the recording density of the detected recording element; and an image correction step of correcting, for each of the plurality of recording elements, data of an image outputted by the plurality of recording elements onto the recording medium, according to the correction value calculated in the density correction value calculation step and the correction value modified in the density correction value modification step.

According to the present invention, a correction value for recording control is calculated on the basis of comparison result of recording information and characteristic information, and when a recording element fulfilling a predetermined condition (detected recording element) is present, the correction value for recording control of a peripheral recording element is modified so as to compensate the recording density of the detected recording element. As a result, even when a recording element (detected recording element) is present for which the correction value corresponding to the comparison result of recording information and characteristic information is insufficient to conduct the appropriate correction, the output produced by the detected recording element is compensated by the peripheral recording element. Therefore, density unevenness of the recorded image caused by such a detected recording element can be reduced and disturbance of the recorded image can be effectively prevented.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DESCRIPTION OF THE PREFERRED EMBODIMENTS

An embodiment of the present invention will be described below with reference to the appended drawings.

First, the ink ejection correction performed during image recording in an inkjet recording apparatus equipped with a plurality of nozzles will be explained and then the configuration of the inkjet recording apparatus will be described. In the embodiment described hereinbelow, the case is illustrated by way of example in which the present invention is applied to an inkjet recording apparatus in which a desired image is formed on a recording medium by ejecting ink from a recording head having a plurality of nozzles, but the present invention is not limited to the inkjet recording apparatus.

Nozzle Ejection Performance

Figure 1:
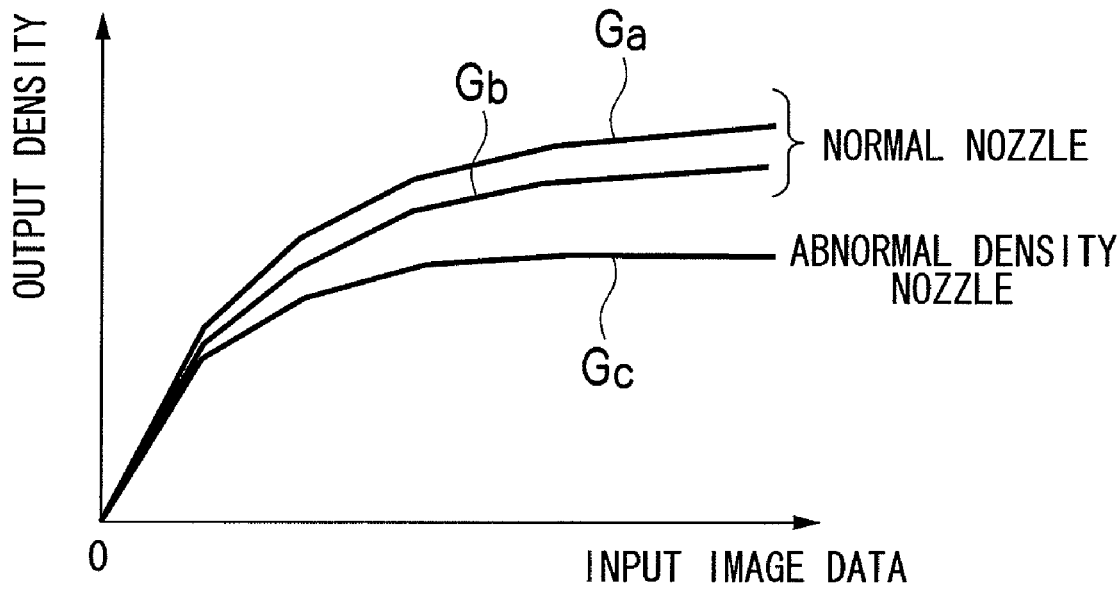
FIG. 1 shows the relationship between input image data (input density data) inputted for ejecting ink from a nozzle and an output density (output density data) of ink dots formed on a recording medium.

FIG. 1 shows the relationship between input image data (input density data) inputted for ejecting ink from a nozzle and an output density (output density data) of an ink dot formed on the recording medium. In FIG. 1, input image data based on tone values are plotted against the abscissa and an output density of an ink dot actually formed on the recording medium by the ink ejected from the nozzle is plotted against the ordinate.

The output density of an ink dot ejected from the corresponding nozzle, as referred to herein, may be not only the density of an ink dot ejected in one cycle from the nozzle, but also an average density represented by an ink dot group ejected in a plurality of cycles, for example, by an ink dot column ejected from the nozzle and arranged in the direction of movement relative to the recording medium. Thus, a technique is also included by which halftone processing or the like is used and the density and continuous density variation are represented by density and number of ink dots.

The nozzles ejecting the ink are classified into "normal nozzles" and "abnormal density nozzles" according to the ejection capability thereof.

The "normal nozzle" as referred to herein is a general term inclusive of a nozzle that can eject a normal amount (appropriate amount) of ink with respect to the input image data (see "$G_a$" in FIG. 1) and a nozzle that cannot eject the normal amount of ink with respect to the input image data, but can eject the normal amount of ink after shading correction processing (ejection correction processing) (see "$G_b$" in FIG. 1).

The "abnormal density nozzle" as referred to herein indicates a nozzle that cannot eject the normal amount of ink even after the shading correction processing (ejection correction processing) that increases the ejection density (ejection amount) (see "$G_c$" in FIG. 1). More specifically, the below-described low-density nozzle is included in the abnormal density nozzles.

In the below-described embodiment, not only a nozzle that cannot eject the ink at all (non-ejecting nozzle) is detected, but such a non-ejecting nozzle is detected and processed as an "abnormal density nozzle".

Specific contents of shading correction processing (ejection correction processing) are described below. The shading correction processing includes a processing of correcting the waveform and size of a drive control signal such that the density (amount) of ink ejected from the target nozzle is adjusted and the ink is ejected in an amount larger than the original ejection amount. This processing provides control for ink ejection from the target nozzle. Usually, the ink ejection amount is reduced due to deterioration of ejection performance. Therefore, such a shading correction processing is a processing of increasing the ink ejection amount. However, the shading correction processing conducted when an excess amount of ink is ejected from the target nozzle reduces the ink ejection amount.

In an actual typical ejection device, the amount of ink ejected from one nozzle is difficult to vary in a continuous manner. Therefore, a more often implemented technique includes increasing or decreasing the ejected ink density by changing halftone parameters for each nozzle or by correcting the input image data values.

With the above-described related technique, the usual shading correction processing can deal with the usual nozzles ($G_a$, $G_b$), but the abnormal density nozzle ($G_c$) that cannot eject the normal amount cannot be adequately dealt with by the shading correction processing (ejection correction processing), and disturbance of recorded image caused by such abnormal density nozzle cannot be prevented.

In the below-described embodiment, image quality is increased by ejecting the ink at a density level higher than usual from one or a plurality of nozzles located on the periphery of such abnormal density nozzle, so as to compensate the recording density of the abnormal density nozzle that cannot be dealt with by the related technique. The below-described series of correction processing operations are mainly performed in the control unit of the inkjet recording apparatus.

General Outline of Correction Data Calculation

Figure 2:
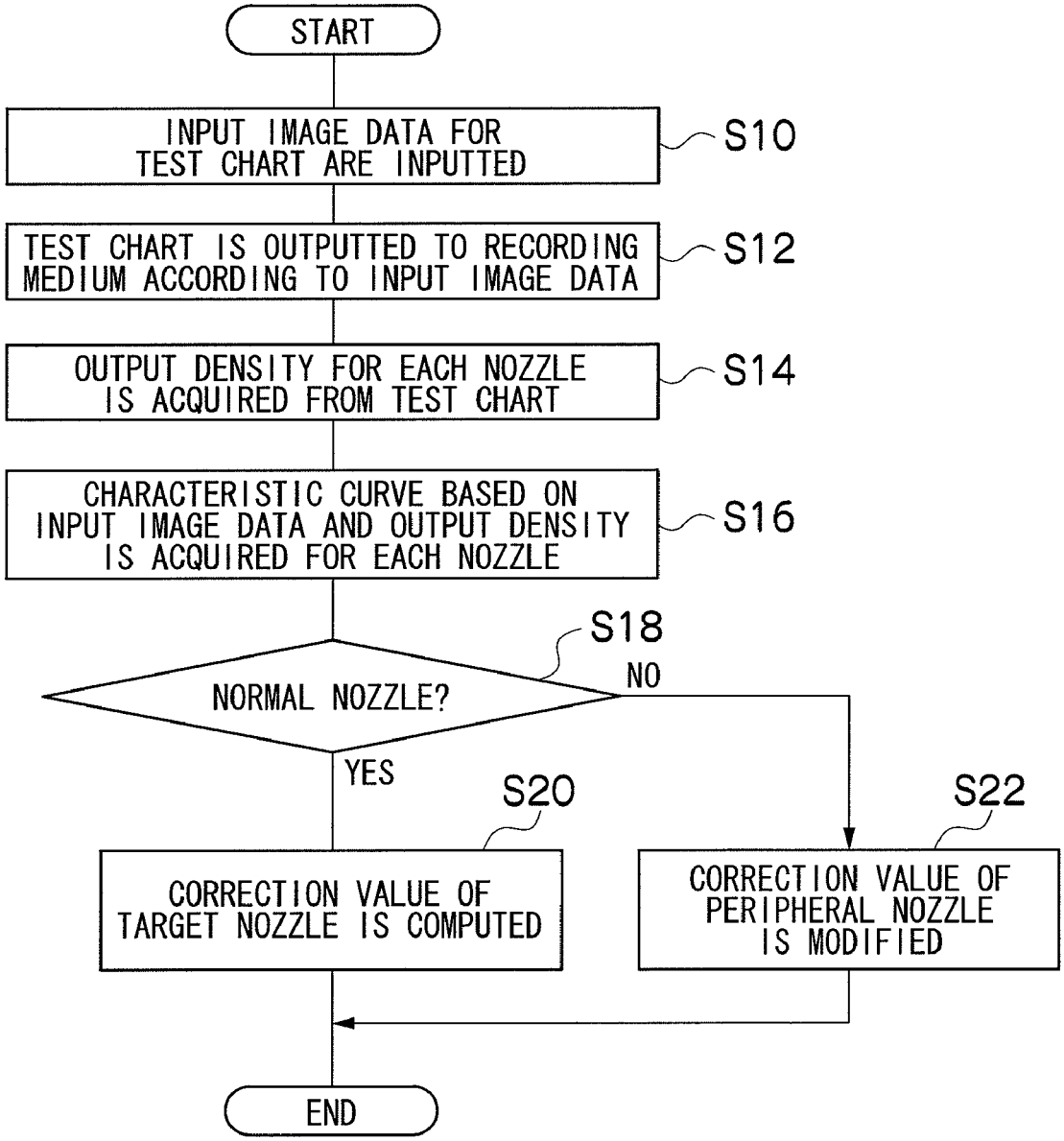
FIG. 2 is a flowchart showing an example of correction processing of nozzle ejection performance.

FIG. 2 is a flowchart showing an example of correction processing of nozzle ejection performance.

In the present embodiment, a test chart (recording density pattern) is used to determine whether the target nozzle is a normal nozzle or an abnormal density nozzle. Thus, a drive control signal based on input image data for a patch (test chart) with varied tone density is inputted to a drive element (for example, the below-described piezoelectric drive element composed of a common electrode 156, an individual electrode 157, and an actuator 158) corresponding to each nozzle (S10 in FIG. 2), and ink is ejected from each nozzle on the basis of the input image data and a test chart is outputted and recorded on the recording medium (S12).

Figure 3:
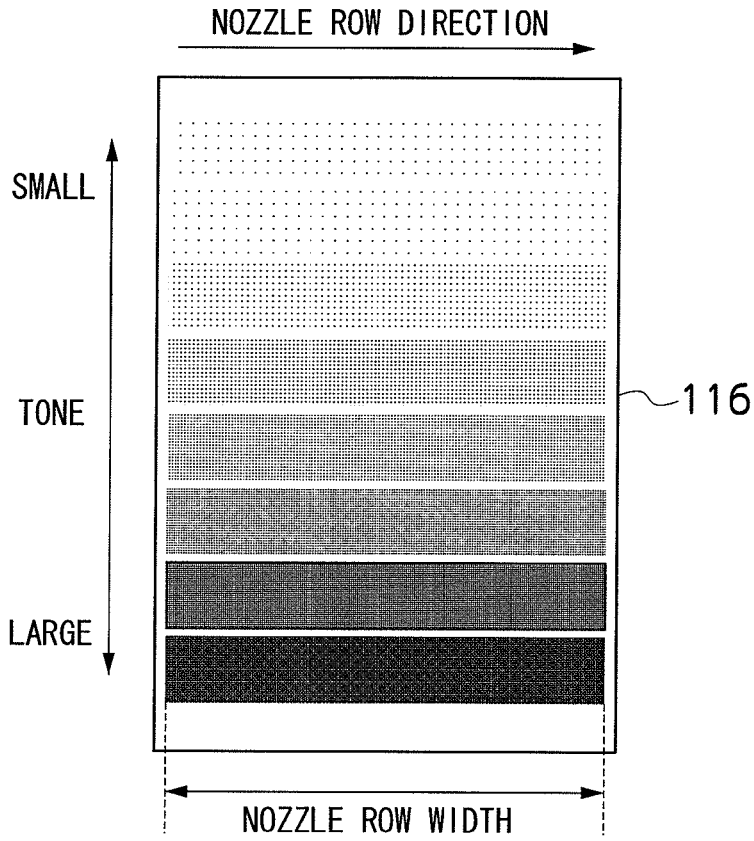
FIG. 3 illustrates an example of a test chart recorded on a recording medium.

FIG. 3 shows an example of the test chart recorded on a recording medium 116. FIG. 3 shows a test chart obtained when the recording head is a so-called line head and illustrates an example in which the test chart is formed by ejecting the ink from the nozzles of the recording head provided over substantially the entire width of the recording medium 116. FIG. 3 shows the direction of a nozzle row (nozzle row direction) formed by a plurality of nozzles of the recording head and a width of the nozzle row (nozzle row width). A test chart with a plurality of stages is formed by continuously recording the ink dots so that the density tone value increases in a stepwise manner from up to bottom in FIG. 3. In this case, the density in the nozzle row direction is substantially constant.

After such a test chart is recorded on the recording medium, an output density of each nozzle can be acquired on the basis of this test chart (S14 in FIG. 2). A specific acquisition process will be described below. In general, an OD (Optical Density) value in each position of the test chart (scan image) is obtained and output density data indicating the output recording density for each recording element (nozzle or the like) corresponding to each position are acquired from the OD values of the test chart. The test chart is read and acquired by the below-described printing detection unit.

Then, a characteristic curve (test characteristic curve) of each nozzle is obtained on the basis of the input image data and output density data that are thus obtained (S16).

Figure 4:
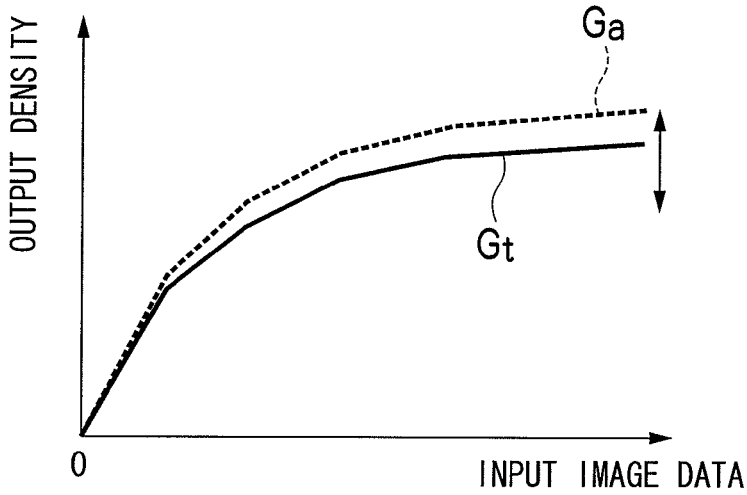
FIG. 4 is a graph showing a characteristic curve of a nozzle.

FIG. 4 is a graph showing a characteristic curve of a nozzle. In this graph, the output density data are plotted against the ordinate and the input image data are plotted against the abscissa. The output density increases (output amount increases) with the distance from the origin point 0 in the vertical direction, and the density tone of input image data increases with the distance in the transverse direction. As shown in FIG. 4, the characteristic curve (test characteristic curve) $G_t$ of the nozzle obtained from the test chart is usually somewhat shifted, due to external disturbance or the like, from a characteristic curve (appropriate characteristic curve) $G_a$ obtained in a case in which the ink is ejected from the nozzle in a normal amount (appropriate amount) with respect to the input image data, and as shown by an arrow in FIG. 4, variation in the output density value is observed among the nozzles.

Thus, both the test characteristic curve $G_t$ and the appropriate characteristic curve $G_a$ are based on the input density data inputted to the recording elements (ink ejection actuator) and the output density data of the recording elements, the test characteristic curve $G_t$ represents recording information of the recording elements and the appropriate characteristic curve $G_a$ represents characteristic information in an appropriate state (normal state) of the recording elements.

Then, the output density data of the test characteristic curve $G_t$ and the output density data of the appropriate characteristic curve $G_a$ are compared for each nozzle (each recording element), and a correction value for ejection control (recording control) is calculated for each recording element on the basis of the comparison results. In the present example, a critical density value established on the basis of the appropriate characteristic curve $G_a$ as described hereinbelow and the output density data of the test characteristic curve $G_t$ of the target nozzle are compared, and when the output density data of the test characteristic curve $G_t$ are greater than the critical density value, the target nozzle is determined to be a normal nozzle. When the output density data of the test characteristic curve $G_t$ are equal to or less than the critical density value, the target nozzle is determined to be an abnormal density nozzle (S18 in FIG. 2).

When the target nozzle is determined to be a normal nozzle on the basis of the comparison result (YES in S18), a correction value for shading correction processing necessary to eject the ink of appropriate density from the target nozzle is calculated (S20). Thus, a correction value (correction data) is calculated such that the ink of the appropriate output density is ejected from the target nozzle by further ejecting from the target nozzle a difference amount between an output density (recording density) indicated by the output density data of the test characteristic curve $G_t$ of the target nozzle and the output density (recording density) indicated by the output density data of the appropriate characteristic curve $G_a$ of the target nozzle, this procedure being described below in greater detail.

When the target nozzle is determined to be an abnormal density nozzle, rather than a normal nozzle (NO in S18), a correction value for ejection control (recording control) of a peripheral nozzle disposed on the periphery of the target nozzle is modified on the basis of the test characteristic curve $G_t$ and appropriate characteristic curve $G_a$ so as to compensate the ejection of the target nozzle (S22). In the present example, a correction value for ejection control (recording control) of the target nozzle that is an abnormal density nozzle and the corresponding drive element (recording element) thereof is determined in the same manner as in the usual shading correction processing. Meanwhile, a correction value for ejection control of the peripheral nozzle and the corresponding drive element thereof is modified on the basis of a difference between the output density data obtained in ejection from the target nozzle after the input image data relating to the target nozzle has been corrected on the basis of the correction value and the output density data of the appropriate characteristic curve $G_a$.

The correction value for ejection control of the normal nozzle and abnormal density nozzle is thus obtained for each nozzle, the input image data of the desired image are corrected on the basis of the correction value, and an image is formed on the recording medium on the basis of the input image data after correction.

General Outline of Correction Processing

Figure 5:
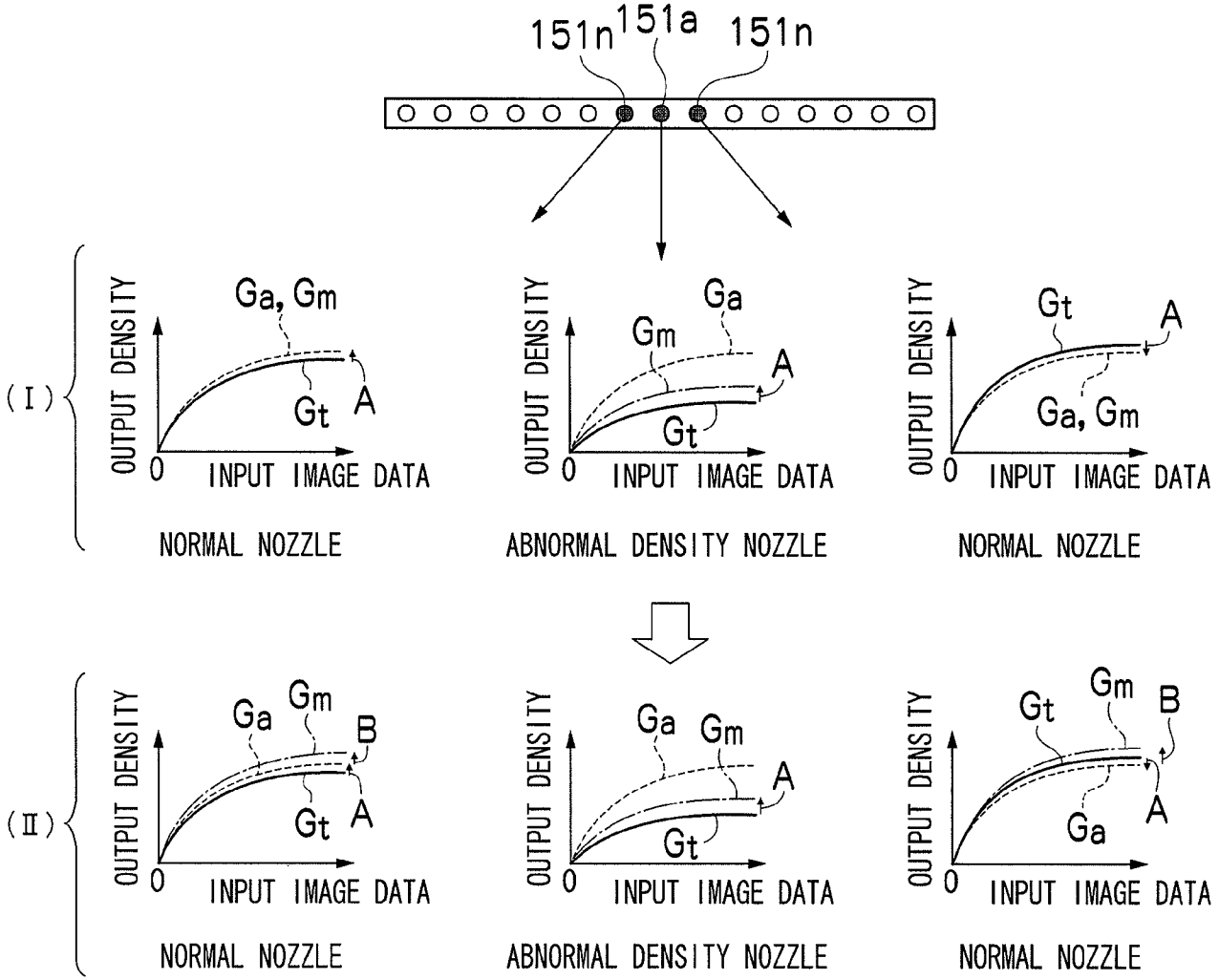
FIG. 5 shows an outline of correction processing.

FIG. 5 illustrates a general outline of the correction processing. FIG. 5 shows by way of example a case in which a certain nozzle is an abnormal density nozzle 151*a*, and nozzles adjacent to the abnormal density nozzle 151*a* are normal nozzles 151*n*.

(I) of FIG. 5 shows the relationship between input image data and output density data based on typical shading correction processing, and (II) of FIG. 5 shows the relationship between input image data and output density data based on shading correction processing of the present embodiment. In FIG. 5, similarly to FIG. 1, the output density data and input image data are plotted against the ordinate and abscissa, respectively, and "$G_m$" shows the relationship between the output density data ejected from the nozzle after the correction and input image data.

In the correction processing shown in (I) of FIG. 5, a differential amount (correction value) is added to the input image data value such that the output density of each nozzle obtained from the test chart data (test characteristic curve $G_t$) match the output density data of each nozzle outputted in an appropriate state (appropriate characteristic curve $G_a$). As a result, the appropriate amount of ink is ejected from each nozzle and correction is performed such that the output density data after correction come close to the output density data of the appropriate characteristic curve $G_a$.

However, although the correction processing shown in (I) of FIG. 5 is effective with respect to the normal nozzle, it is not necessarily effective with respect to the abnormal density nozzle. Thus, in an abnormal density nozzle that can eject only an ink amount of extremely low density, the output of an appropriate ink density cannot be attained even with the typical shading correction processing (see "$G_m$" of the "abnormal density nozzle" in (I) of FIG. 5), and the output density data cannot reach the appropriate amount (see $G_a$). For this reason, the typical shading correction processing cannot be said to be always adequate against image density unevenness caused by such abnormal density nozzles.

A common feature of the correction processing of the present embodiment that is shown in (II) of FIG. 5 and the correction processing shown in (I) of FIG. 5 is that when a correction value for each nozzle (recording element) is calculated, a difference value is added to the input image data value such that the output density data obtained from the test chart match the output density data during appropriate output (see arrow "A" in FIG. 5). However, in the correction processing shown in (II) of FIG. 5, the correction is performed such that the ink of a density corresponding to the difference between the output density (see $G_m$) after correction of the abnormal density nozzle and the output density data (see $G_a$) in an appropriate state is further ejected from the adjacent nozzles (see arrow "B" in FIG. 5). As a result, the deficiency of ink output density ejected from the abnormal density nozzle is compensated by the ink output density ejected from the adjacent nozzles.

The deficiency of ink output density of the abnormal density nozzle may be compensated by the ink output density ejected not only from the adjacent nozzles, but also from other nozzles (peripheral nozzles) surrounding the abnormal density nozzle. It is preferred that nozzles recording ink dots (image) in opposing positions on the recording medium between which the ink dot recorded by the abnormal density nozzle is positioned (for example, positions forming an angle of 180 degrees, the abnormal density nozzle being taken as a center) be selected as such peripheral nozzles including the adjacent nozzle. In this case, since the recording and correction of the peripheral recording elements is performed in such a manner that a low-density ink dot from the abnormal density nozzle is recorded between the ink dots from the peripheral recording elements, density unevenness caused by the abnormal density nozzle can be effectively reduced.

The correction processing of each nozzle (each recording element) will be described below in greater detail with reference to FIGS. 6 to 8.

Figure 6:
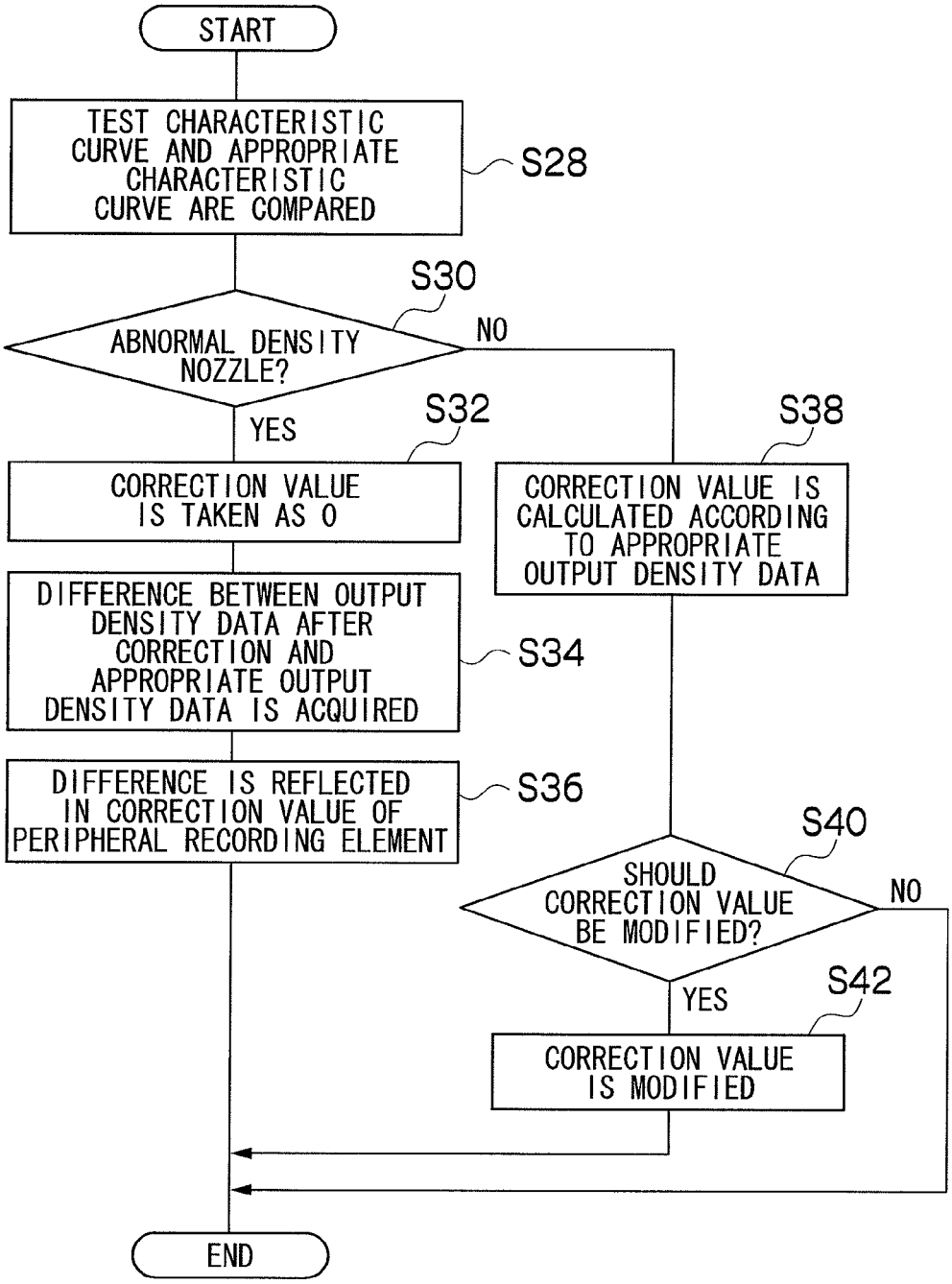
FIG. 6 is a flowchart showing a process of calculating a correction value of a target nozzle.

FIG. 6 is a flowchart showing a process of calculating a correction value of a target nozzle. First, the output density data of the test characteristic curve of the target nozzle are compared with the output density data of the appropriate characteristic curve of the target nozzle with reference to the input image data (S28), and whether the target nozzle is a normal nozzle or an abnormal density nozzle is determined (S30). More specifically, the aforementioned determination is made on the basis of whether the output density data of the test characteristic curve exceed the critical density value $D_c$ that is obtained in advance from the output density data of the appropriate characteristic curve. When the output density data of the test characteristic curve exceed the critical density value $D_c$, the target nozzle is determined to be a normal nozzle (NO in S30), and when the output density data of the test characteristic curve are equal to or less than the critical density value $D_c$, the target nozzle is determined to be an abnormal density nozzle (YES in S30).

When the target nozzle is determined to be an abnormal density nozzle (YES in S30), the input image data value sometimes cannot be changed to match the test characteristic curve with the appropriate characteristic curve of the nozzle. In this case, the input image data value is not changed with respect to this nozzle, that is, the correction value is taken as zero (0) and substantially no correction is performed with respect to the ejection control of the abnormal density nozzle and the corresponding drive element thereof (S32).

Meanwhile, a difference is calculated between the output density data of the appropriate characteristic curve and the output density data that will be outputted from the target nozzle after the correction based on this correction value (see "Δ" in FIG. 7) (S34), and this difference is reflected in the correction value of the peripheral nozzle as will be described below (S36).

When the target nozzle is determined to be a normal nozzle (NO in S30), a difference in the input image data value such that the appropriate output density data of the appropriate characteristic curve matches the output density data of the test characteristic curve is calculated as a correction value of the target nozzle, so that the appropriate output density indicated by the appropriate characteristic curve of the target nozzle is outputted (S38). Further, it is determined whether additional modification of the correction value is necessary due to other peripheral nozzles being abnormal density nozzles (S40). When the additional modification is necessary (YES in S40), the correction value is modified on the basis of a difference in the input image data value such that the output density data that will be outputted after the correction from an adjacent abnormal density nozzle match the output density data of the appropriate characteristic curve (S42). When there is no abnormal density nozzle on the periphery and the additional modification is not necessary (NO in S40), the correction value of the target nozzle is not modified and becomes a correction value such that the appropriate output density is outputted from the target nozzle.

Figure 7:
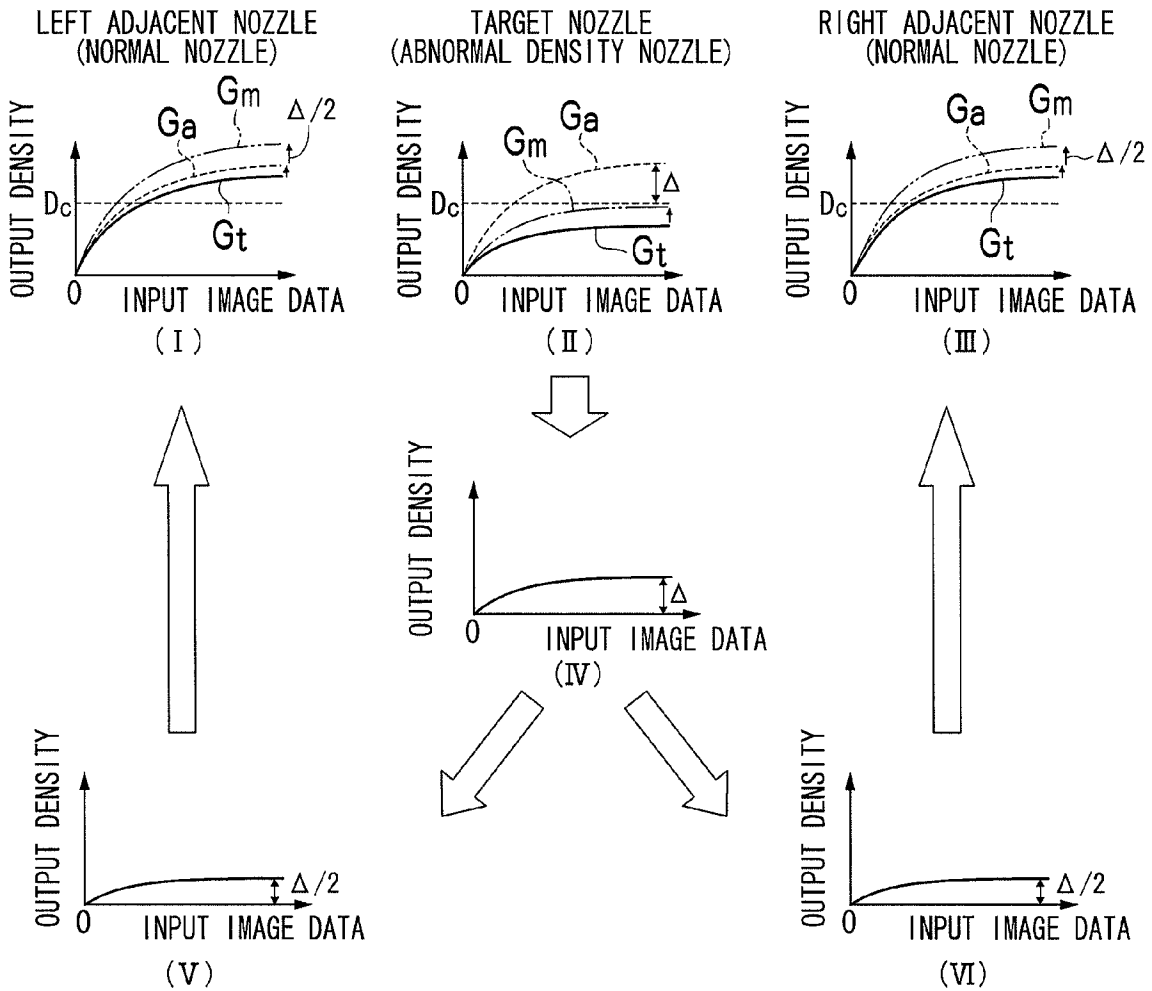
FIG. 7 illustrates a correction value calculation process.

FIG. 7 illustrates the process of calculating a correction value when the target nozzle is determined to be an abnormal density nozzle and the adjacent nozzles on the left and right sides of the target nozzle are determined to be normal nozzles. In FIG. 7, similarly to FIG. 1, the output density data and input image data are plotted on the ordinate and abscissa, respectively.

A difference Δ is calculated between the output density data ($G_a$) of the appropriate characteristic curve and the output density data ($G_m$) of ink that will be outputted after the correction from the target nozzle (see (II) of FIG. 7) determined to be an abnormal density nozzle because the output density data ($G_t$) of the test characteristic curve do not exceed the critical density value $D_c$, as mentioned hereinabove (see (IV) of FIG. 7). This difference Δ is distributed to the output density data of the appropriate characteristic curve of nozzles (see (I) and (III) of FIG. 7) adjacent to the target nozzle. In the present example, a value corresponding to ½ of this difference Δ is further allocated to both adjacent nozzles (see (V) and (VI) of FIG. 7). Thus, when an abnormal density nozzle is adjacent, the correction value of the adjacent nozzle that is determined to be a normal nozzle is a value obtained by modification of the input image data value such that the output density of the appropriate amount (normal amount) which the value corresponding to ½ of the difference Δ having been reflected therein and added thereto is outputted (see (I) and (III) of FIG. 7).

Thus, an ink amount corresponding to the output density that cannot be outputted from the target nozzle (abnormal density nozzle) is additionally outputted from the left and right adjacent nozzles and deterioration of image quality is prevented.

The "adjacent nozzle" or "peripheral nozzle" in the present example relates to ink dots formed on the recording medium and is a nozzle that forms an ink dot present on the recording medium adjacently or peripherally with respect to the ink dot recorded by the target nozzle. Therefore, when a nozzle row is formed as one row in the recording head (line head), nozzles that are disposed adjacently or peripherally with respect to the target nozzle in the recording head are generally the adjacent nozzles or peripheral nozzles. Further, when a plurality of nozzles have an irregular arrangement such as the below-described matrix arrangement in the recording head or when an irregular recording system is used, the nozzles disposed adjacently or peripherally to the target nozzle in the recording head do not necessarily correspond to the adjacent nozzles or peripheral nozzles with respect to the target nozzle.

The correction value calculated and modified in the above-described manner is calculated for each recording element (nozzle and the corresponding drive element thereof) of the recording head, held as shading information in a storage device, and referred to when the input image data of a desired image are inputted from a host computer or the like, thereby executing the correction processing adequate for the input image data.

As described hereinabove, when the target nozzle is determined as an abnormal density nozzle, the correction value of the input image data value of the target nozzle sometimes cannot be determined. Therefore, the correction value can be set to "0.0" and it is possible to perform substantially no correction of ejection control. In this case, the output density outputted from the abnormal density nozzle after correction becomes equal to the output density data of the test characteristic curve and the characteristic curves $G_m$ and $G_t$ shown in (II) of FIG. 7 coincide.

Further, the critical density value $D_c$ is a value that is determined in advance on the basis of characteristic information of the appropriate characteristic curve $G_a$, and for example, a value based on a boundary value that does not degrade the visual image quality with reference to the output density data of the appropriate characteristic curve $G_a$ can be used as the critical density value $D_c$. Further, the critical density value $D_c$ may be changed according to input image data. The value of such critical density value $D_c$ that changes according to the input image data can be also determined for example such that the difference between the output density value of characteristic information of the appropriate characteristic curve $G_a$ and the critical density value $D_c$ is constant for all the input image data. Whether the target nozzle is a normal nozzle or an abnormal density nozzle can be also determined according to whether the output density data of the test characteristic curve obtained from the test chart are contained in a predetermined range based on the characteristic information of the appropriate characteristic curve $G_a$. When such a predetermined range is determined, the upper-limit critical density value and lower-limit critical density value may be determined on the basis of characteristic information of the appropriate characteristic curve $G_a$.

Shading Correction Processing

The shading correction processing will be explained below with reference to FIG. 8. FIG. 8 is an explanatory drawing illustrating an example of the shading correction processing.

Figure 8:
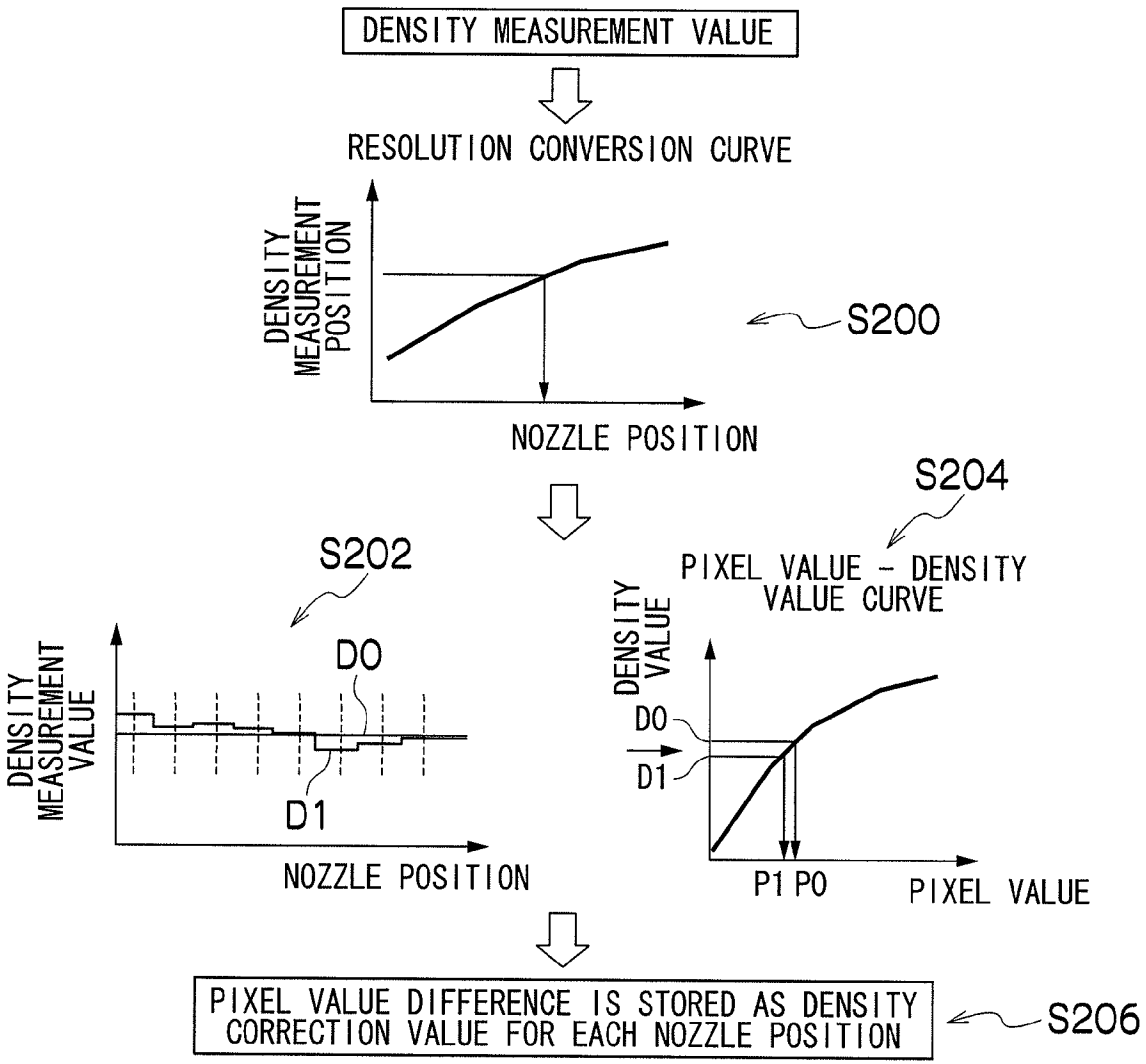
FIG. 8 is an explanatory drawing showing an example of shading correction processing.

As shown in S200 in FIG. 8, a resolution conversion curve indicating the correspondence relationship of a pixel position (density measurement position) of a scanner and a nozzle position is measured and stored in advance, and density measurement positions (for example, a 400 dpi resolution) in the scanned image of the test chart are converted into positions (for example, a 1200 dpi resolution) of the corresponding nozzles in the recording head according to this resolution curve.

The nozzle positions thus obtained and the density measurement values (output density values) D1 in the test chart corresponding to the nozzle positions are associated as shown in S202 in FIG. 8, and a difference between the target density value D0 that has been determined and stored in advance and the density measurement value (output density value) D1 is calculated. The target density value D0 used herein is a target value of ink density ejected from the target nozzle and can be appropriately determined as necessary. For example, an average density of ink ejected from a predetermined nozzle range may be calculated and stored as the target density value D0.

Further, as shown in S204 of FIG. 8, output pixel values ("pixel values" of S204) P0, P1 corresponding to the density measurement value (output density value) D0 and target density value D1 ("density value" of S204) are obtained according to a pixel value—density value curve that has been obtained experimentally in advance and shows the correspondence relationship between pixel values and density values. The difference amount (P0-P1) between the output pixel values is stored as a density correction value for each nozzle position (shading information) (S206 of FIG. 8) and referred to when the correction processing is executed.

In the example shown in FIG. 8, a correction processing is shown by which the number of droplet ejections from the target nozzle (pixel value) is increased or decreased, but a processing that increases or decreases the size of ink droplets ejected from the target nozzle may be also used.

Correction Processing and Image Output

Where the correction processing based on the information (shading information) relating to the correction value for each nozzle that has been calculated and modified in the above-described manner is implemented for each nozzle with respect to input image data for forming a desired image, it is possible to form on the recording medium a high-quality image from which density unevenness has been effectively eliminated. The above-described correction processing is also effective during image output following the halftone processing.

Figure 9:
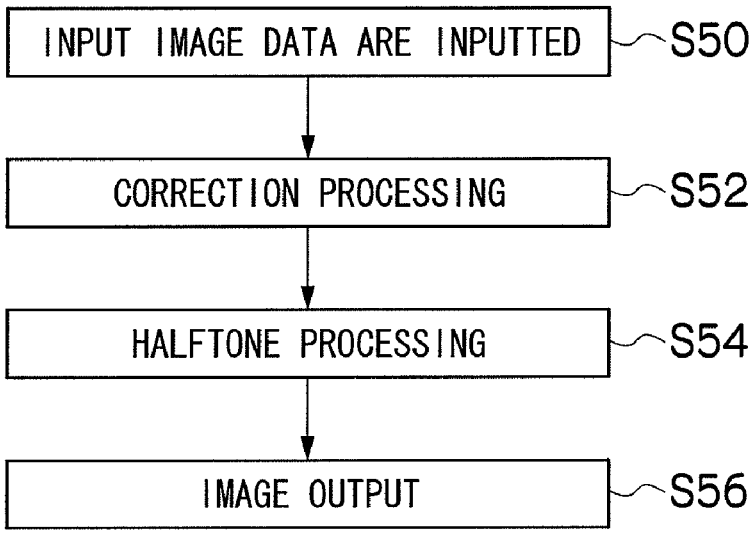
FIG. 9 is a flowchart showing an example of image output processing that accompanies a halftone processing.
Figure 10:
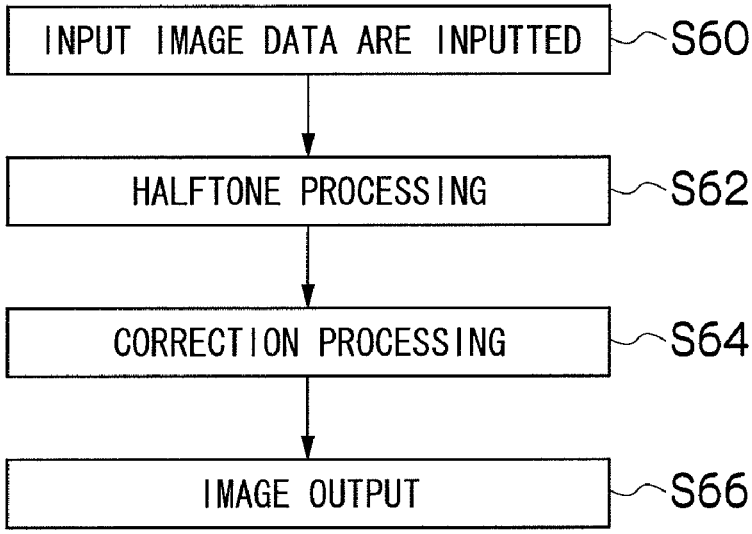
FIG. 10 is a flowchart showing an example of image output processing that accompanies a halftone processing.

FIGS. 9 and 10 show flowcharts illustrating examples of image output processing following the halftone processing.

A common feature of the examples shown in FIGS. 9 and 10 is that input image data for forming the desired image are inputted, the halftone processing is performed on the basis of the input image data, and image output is performed on the basis of the data after halftone processing (S50, S54, and S56 of FIG. 9 and S60, S62, and S66 of FIG. 10). However, the examples shown in FIGS. 9 and 10 differ in whether the timing at which the above-described correction processing is implemented is before or after the halftone processing. Thus, the above-described correction processing may be performed before the halftone processing as shown in FIG. 9, or after the halftone processing as shown in FIG. 10. Taking into account the difficulty of computing in halftone processing, implementing the above-described correction processing after the halftone processing, as shown in FIG. 10, can simplify the computations and shorten the processing time.

The above-described calculation and modification of correction value can be executed at any timing. For example, the correction value may be calculated and modified by outputting the test chart to a margin of recording medium each time the image is outputted, or the correction value may be calculated and modified during periodic maintenance or when indicated by the user.

Further, the detection of normal nozzles and abnormal density nozzles may be conducted each time the test chart is outputted. The processing of detecting whether a nozzle is a normal nozzle or an abnormal density nozzle can be also omitted when information on the nozzle detected as an abnormal density nozzle is held in a storage device and the nozzle that has been detected in the past as an abnormal density nozzle is handled as an abnormal density nozzle with reference to this information in the subsequent detection cycles. However, even if there is a nozzle that has once been detected as an abnormal density nozzle, the ejection performance is sometimes restored by head cleaning or image recording and therefore more accurate correction processing can be conducted when the processing of detecting whether a nozzle is a normal nozzle or an abnormal density nozzle is conducted for each output of the test chart.

Effects of Correction Processing

In the present embodiment, the correction processing based on a correction value that is calculated and modified in the above-described manner is performed for each recording element (nozzle, drive actuator, and the like). Therefore, density unevenness of the recording image caused by variation in ejection performance of the recording elements can be effectively reduced. In particular, accurate correction by ink output from peripheral nozzles can be also performed with respect to recording control (ejection control) of an abnormal density nozzle and a corresponding drive element thereof that can eject ink, but can only output ink of an extremely low density and cannot be caused to eject ink of sufficient density even by the shading correction processing. Therefore, with the inkjet recording apparatus of the present embodiment, density unevenness caused by an abnormal density nozzle, such that is difficult to handle in the conventional devices, can be reduced by adequate correction processing and disturbance of recorded images can be effectively prevented.

In the above-described embodiment, a nozzle that cannot eject ink at all (non-ejecting nozzle) is detected as an abnormal density nozzle. Thus, output density data of the test characteristic curve $G_t$ of the non-ejecting nozzle that is obtained from the test chart is zero (0) in the graph of (II) of FIG. 7, regardless of the input image data, the correction value of correction for ejection control is also zero (0), the correction value of peripheral nozzles (adjacent nozzles) is modified, and the recording of the non-ejecting nozzle is covered.

Figure 11:
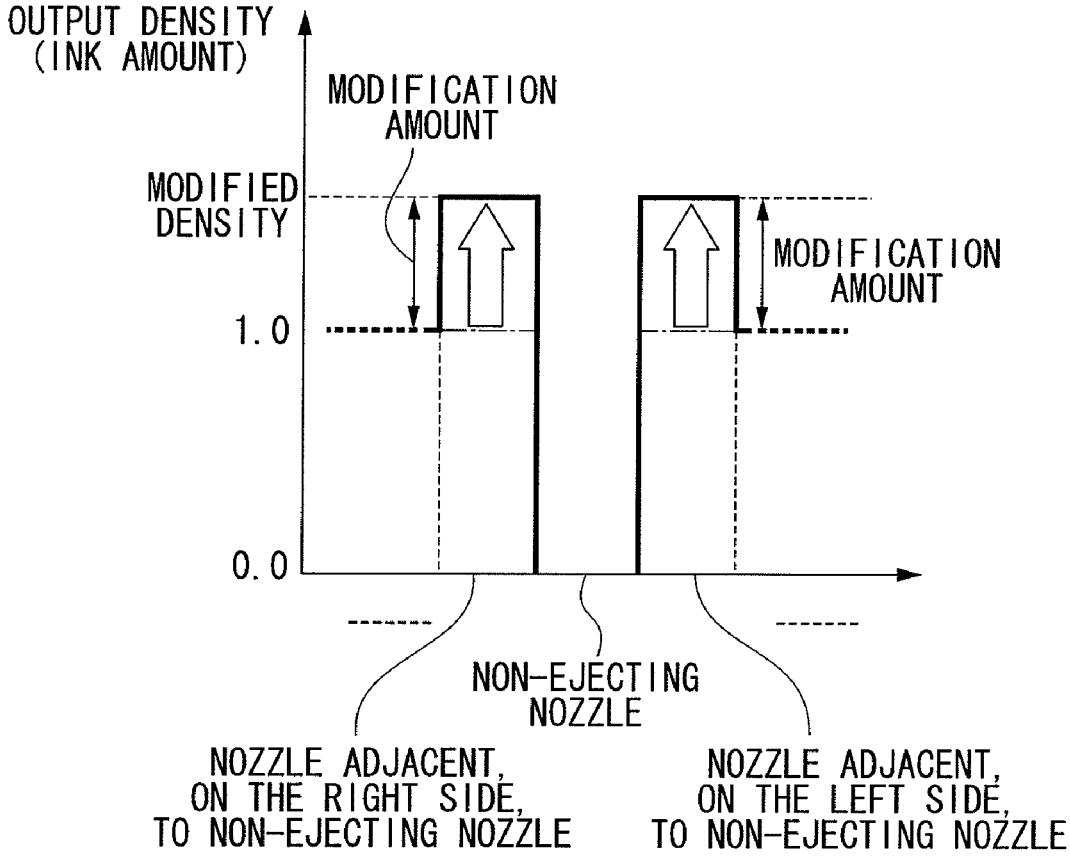
FIG. 11 shows an example of non-ejection correction processing.

FIG. 11 shows an example of correction processing for ejection control of a non-ejecting nozzle. In this example, when a target nozzle is a non-ejecting nozzle, ink ejection density for both, left and right, nozzles ("nozzle adjacent, on the left side, to non-ejecting nozzle" and "nozzle adjacent, on the right side, to non-ejecting nozzle" in FIG. 11) that are adjacent in the nozzle row direction in FIG. 3 is corrected. In FIG. 11, each of a plurality of nozzles arranged side by side in the nozzle row direction is represented on the abscissa, and the ink output density (ink amount) ejected from the nozzles is plotted against the ordinate.

In the correction processing of the present example, as shown in FIG. 11, since the target nozzle is a non-ejecting nozzle (that is, the output density of the target nozzle is "0.0"), the correction value for ejection control of the adjacent nozzles is modified so that an amount of ink larger than the original ejection amount is ejected from the nozzles adjacent to the target nozzle and the output density of these adjacent nozzles is increased. The color of ink ejected from the adjacent nozzles at this time is identical to the color of ink ejected from the target nozzle.

In the correction processing shown in FIG. 11, the output density of ink ejected from the left and right adjacent nozzles before the modification processing is represented by 1.0, the output density of ink ejected from the left and right adjacent nozzles after the modification processing is represented as "modified density", and the ink output density of the nozzles adjacent to the target nozzle that is increased by the non-ejection correction processing is represented as "modification amount" (for example, modification ratio of "1.5").

In the correction processing shown in FIG. 11, the modification amount of the correction value for the adjacent nozzles is uniform among the adjacent nozzles, but the modification amount of the correction value for the nozzles adjacent to the target nozzle and drive elements thereof can be appropriately determined as necessary. For example, the ratio of output density of ink ejected from the left and right adjacent nozzles after the modification processing can be appropriately selected within a range of 1.0 to 2.0.

The modification processing may be also conducted by using nozzles (peripheral nozzles) other than the nozzles adjacent to the target nozzle. The recording of the target nozzle can be compensated from both sides by conducting a correction processing using as the adjacent nozzles (peripheral nozzles) the nozzles on both sides of the target nozzle, desirably in positions at an angle of 180 degrees, with the target nozzle as a center.

Further, when there is an error in the landing position of an ink dot outputted from a nozzle in the widthwise direction (nozzle row direction), the modification ratio (modification amount) may be calculated by taking this ejection position error (landing position error) into account. For example, when the landing position of ink ejected from an adjacent nozzle on the recording medium is far from the original landing position (landing position during appropriate ejection) of ink ejected from the target nozzle due to such an ejection position error, the modification ratio may be increased over that in the usual state. Conversely, when the landing position of ink ejected from an adjacent nozzle on the recording medium is close to the original landing position of ink from the target nozzle due to the ejection position error, the modification ratio (modification amount) may be reduced below that in the usual state.

The correction for ejection control of the adjacent nozzles based on the correction value that has thus been calculated and modified is performed by a processing of changing the image data so as to increase or decrease the number of droplets ejected on the recording medium (number of dots) or by a processing of increasing or decreasing the size of ink droplets ejected from the adjacent nozzles.

Whether the target nozzle is a non-ejecting nozzle that cannot eject the ink at all can be appropriately detected in addition to and separately from the above-described modification processing.

Configuration of Inkjet Recording Apparatus

The configuration of the inkjet recording apparatus of the present embodiment will be described below. The contents repeating the explanation provided above will be omitted.

Figure 12:
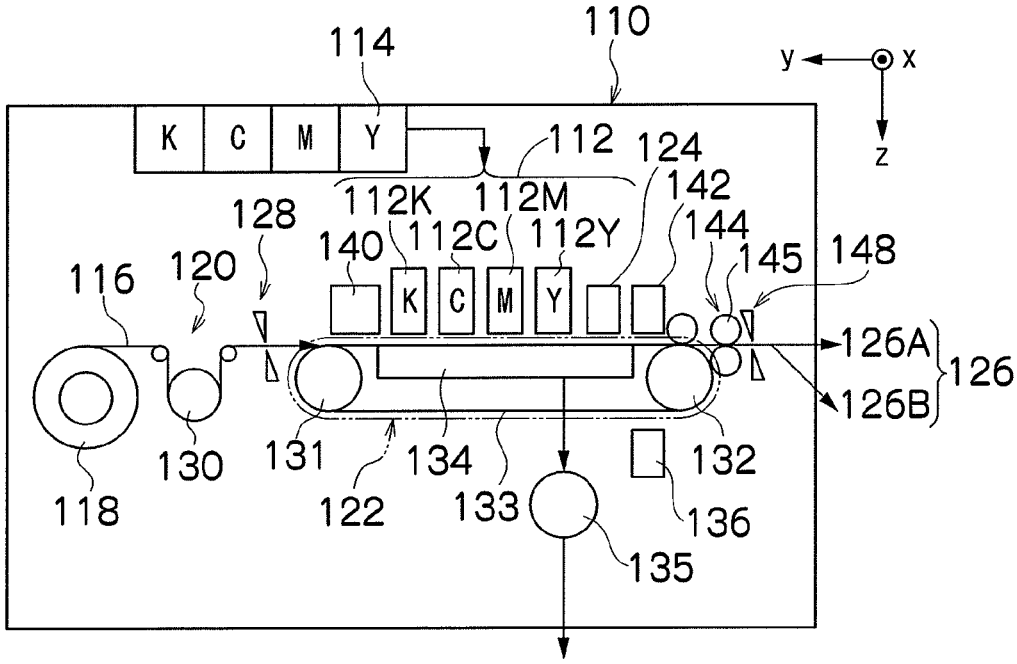
FIG. 12 shows the entire configuration of an inkjet recording apparatus using an image processing device according to one embodiment of the present invention.

FIG. 12 is a general configuration diagram of an image forming device according to one embodiment of the present invention. As illustrated in FIG. 11, the inkjet recording apparatus 110 according to the present embodiment comprises: a recording head (printing unit) 112 having a plurality of inkjet recording heads (hereafter, also simply called "heads") 112K, 112C, 112M, and 112Y provided for the respective ink colors (i.e. black, cyan, magenta and yellow); an ink storing and loading unit 114 for storing inks of K, C, M and Y to be supplied to the printing heads 112K, 112C, 112M, and 112Y; a paper supply unit 118 for supplying recording paper (recording medium) 116; a decurling unit 120 removing curl in the recording paper (recording medium) 116; a belt conveyance unit 122 disposed facing the nozzle face (ink-droplet ejection face) of the recording head 112, for conveying the recording paper 116 while keeping the recording paper 116 flat; a print determination unit 124 for reading the recorded result produced by the recording head 112; and a paper output unit 126 for outputting image-printed paper (printed matter) to the exterior.

The ink storing and loading unit 114 comprises ink tanks for storing inks of colors corresponding to the heads 112K, 112C, 112M and 112Y, and the ink tanks are respectively connected to the heads 112K, 112C, 112M and 112Y via prescribed channels. The ink storing and loading unit 114 also comprises a warning device (for example, a display device or an alarm sound generator) for warning when the remaining amount of any ink is low, and has a mechanism for preventing loading errors between different colors.

Figure 13:
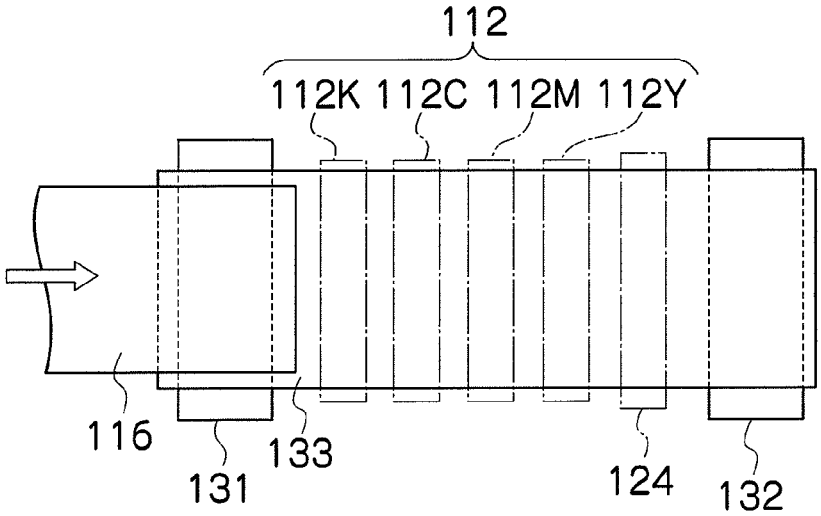
FIG. 13 is a principal plan view of a recording head periphery in the inkjet recording apparatus shown in FIG. 12.

In FIG. 13, a magazine for rolled paper (continuous paper) is illustrated as an example of the paper supply unit 118; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording media can be used, it is desirable that an information recording medium such as a bar code and a wireless tag containing information about the type of medium is attached to the magazine, and by reading the information contained in the information recording medium with a predetermined reading device, the type of medium to be used is automatically determined, and ink-droplet ejection is controlled so that the ink-droplets are ejected in an appropriate manner in accordance with the type of medium.

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine. The heating temperature at this time is desirably controlled so that the recording paper 116 has a curl in which the surface on which the print is to be made is slightly round outward.

In the case of a configuration in which roll paper is used, a cutter (first cutter) 128 is provided and the roll paper is cut to a desired size by the cutter 128. When cut paper is used, the cutter 128 is not required.

The decurled and cut recording paper 116 is delivered to the suction belt conveyance unit 122. The suction belt conveyance unit 122 has a configuration in which an endless belt 133 is set around rollers 131 and 132 so that the portion of the endless belt 133 facing at least the nozzle face of the recording head 112 and the sensor face of the print determination unit 124 forms a plane (flat face).

The belt 133 has a width that is greater than the width of the recording paper 116, and a plurality of suction apertures (not illustrated) are formed on the belt surface. A suction chamber 134 is disposed in a position facing the sensor surface of the print determination unit 124 and the nozzle surface of the recording head 112 on the interior side of the belt 133, which is set around the rollers 131 and 132, as illustrated in FIG. 12. The suction chamber 134 provides suction with a fan 135 to generate a negative pressure, and the recording paper 116 on the belt 133 is held by suction. Instead of this suction system, an electrostatic adsorption system may be used The belt 133 is driven in the clockwise direction in FIG. 12 by the motive force of a motor (reference numeral 188 in FIG. 17) being transmitted to at least one of the rollers 131 and 132, which the belt 133 is set around, and the recording paper 116 held on the belt 133 is conveyed from left to right in FIG. 12.

Since ink adheres to the belt 133 when a marginless print job or the like is performed, a belt-cleaning unit 136 is disposed in a predetermined position (a suitable position outside the printing area) on the exterior side of the belt 133. Although the details of the configuration of the belt-cleaning unit 136 are not illustrated, examples thereof include a configuration in which the belt 133 is nipped with cleaning rollers such as a brush roller and a water absorbent roller, an air blow configuration in which clean air is blown onto the belt 133, and a combination of these. In the case of the configuration in which the belt 133 is nipped with the cleaning rollers, it is desirable to make the line velocity of the cleaning rollers different from that of the belt 133 to improve the cleaning effect.

A roller nip conveyance mechanism, in place of the belt conveyance unit 122, can be employed. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is desirable.

A heating fan 140 is disposed on the upstream side of the recording head 112 in the conveyance pathway formed by the belt conveyance unit 122. The heating fan 140 blows heated air onto the recording paper 116 to heat the recording paper 116 immediately before printing so that the ink deposited on the recording paper 116 dries more easily.

The recording head 112 is a so-called "full line head" in which a line head having a length corresponding to the maximum paper width of the recording paper 116 is fixed extending in a direction (main scanning direction) that is perpendicular to the paper conveyance direction (sub scanning direction). Each of the printing heads 112K, 112C, 112M, and 112Y constituting the recording head 112 is constituted by a line head, in which a plurality of ink ejection ports (nozzles) are arranged along a length (entire width of the recordable area) that exceeds at least one side of the maximum-size recording paper 116 intended for use in the inkjet recording apparatus 110 (see FIG. 13).

Therefore, the nozzle row formed by the plurality of nozzles 151 is arranged in the recording head 112 in a range corresponding to the entire width of the recording range of the recording medium 116. Further, a single-pass system is used in which the desired image can be recorded over the entire recording range of the recording medium 116, by one cycle of the relative movement of the recording head 112 and the recording medium 116.

The printing heads 112K, 112C, 112M, and 112Y are arranged in the color order of black (K), cyan (C), magenta (M), and yellow (Y) from the upstream side, along the feed direction of the recording paper 116, and are fixed so as to extend in the direction which is substantially perpendicular to the conveyance direction of the recording paper 116.

A color image can be formed on the recording paper 116 by ejecting the different color inks from the printing heads 112K, 112C, 112M, and 112Y, respectively, onto the recording paper 116 while conveying the recording paper 116 by the belt conveyance unit 122.

By adopting the recording head 112 in which the full line type heads 112K, 112C, 112M, and 112Y having nozzle rows covering the full paper width are provided for the respective ink colors in this way, it is possible to record an image on the full surface of the recording paper 116 by performing just one operation of relatively moving the recording paper 116 and the recording head 112 in the paper conveyance direction (the sub-scanning direction), in other words, by means of a single sub-scanning action. Higher-speed printing is thereby made possible and productivity can be improved in comparison with a shuttle type head configuration in which a recording head reciprocates in a direction (the main scanning direction) orthogonal to the paper conveyance direction.

Although the configuration with the KCMY four standard colors is described in the present embodiment, combinations of the ink colors and the number of colors are not limited to those. Light inks, dark inks or special inks can be added as required. For example, a configuration is possible in which inkjet heads for ejecting light-colored inks such as light cyan and light magenta are added. Furthermore, there are no particular restrictions of the sequence in which the heads of respective colors are arranged.

The print determination unit 124 illustrated in FIG. 12 has an image sensor (line sensor or area sensor) for capturing an image of the ink-droplet deposition result of the recording head 112, and functions as a device to check for ejection properties such as clogs of the nozzles in the recording head 112 and the ink landing position errors from the ink-droplet deposition results evaluated by the image sensor. The print determination unit 124 reads a test chart image or practical image printed by the heads 112K, 112C, 112M, and 112Y for the respective colors, and the ejection of each head is determined. The ejection determination includes measurement of the presence of the ejection, measurement of the dot size, and measurement of the dot deposition position.

The print determination unit 124 according to the present embodiment can read the above-described test chart (see FIG. 3).

A post-drying unit 142 is disposed following the print determination unit 124. The post-drying unit 142 is a device to dry the printed image surface, and includes a heating fan, for example. It is desirable to avoid contact with the printed surface until the printed ink dries, and a device that blows heated air onto the printed surface is desirable.

In cases in which printing is performed with dye-based ink on porous paper, blocking the pores of the paper by the application of pressure prevents the ink from coming contact with ozone and other substances that cause dye molecules to break down, and has the effect of increasing the durability of the print.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed matter generated in this manner is outputted from the paper output unit 126. The target print (i.e., the result of printing the target image) and the test print are desirably outputted separately. In the inkjet recording apparatus 110, a sorting device (not illustrated) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut and separated by a cutter (second cutter) 148. Although not illustrated in FIG. 12, the paper output unit 126A for the target prints is provided with a sorter for collecting prints according to print orders.

Structure of the Head

Next, the structure of heads 112K, 112C, 112M and 112Y will be described. The heads 112K, 112C, 112M and 112Y of the respective ink colors have the same structure, and a reference numeral 150 is hereinafter designated to any of the heads.

Figure 14A:
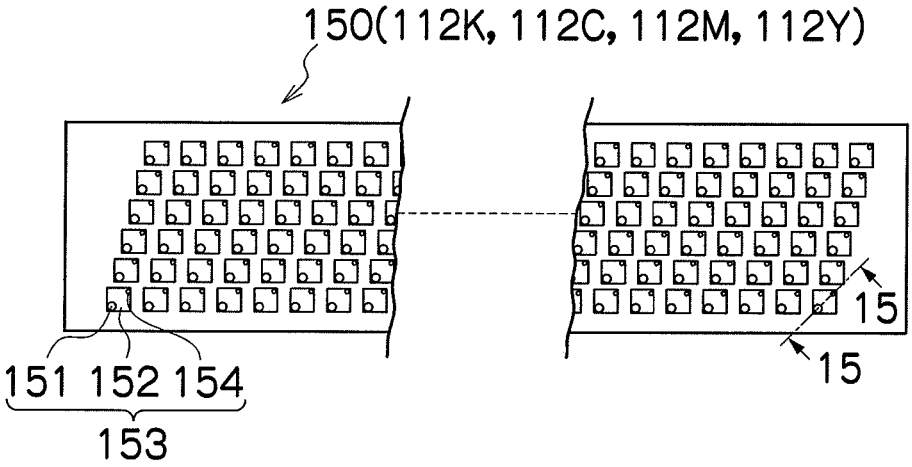
FIG. 14A is a plan transparent view illustrating a structural example of a head.
Figure 14B:
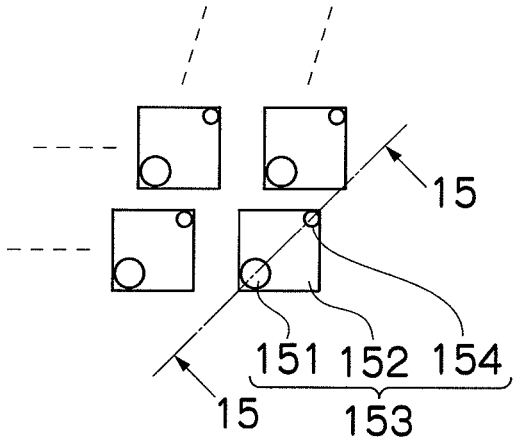
FIG. 14B is a principal enlarged view of the configuration shown in FIG. 14A.
Figure 14C:
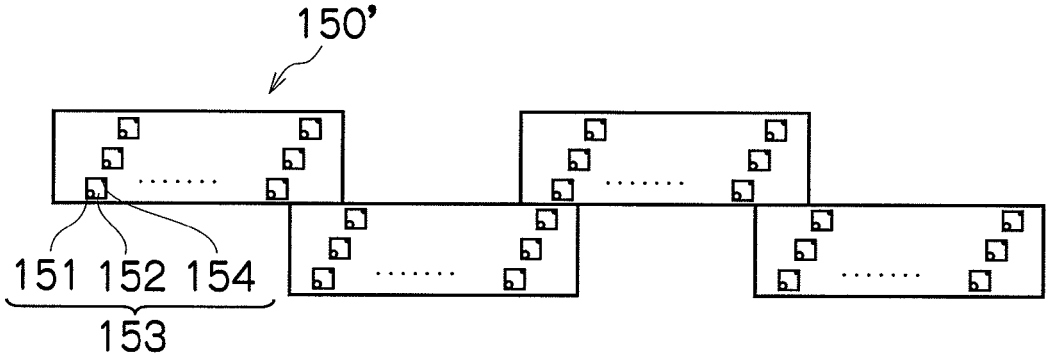
FIG. 14C is a plan transparent view illustrating another structural example of a full-line head.
Figure 15:
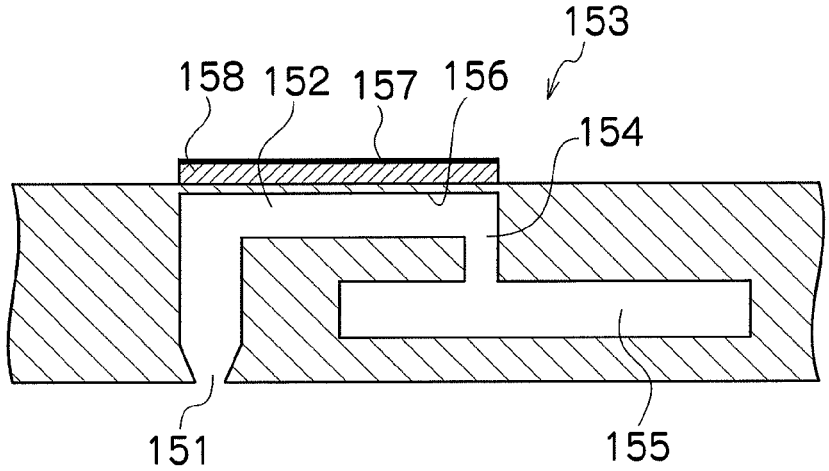
FIG. 15 is a cross-sectional view taken along a 15-15 line in FIGS. 14A and 14B.

FIG. 14A is a plan perspective diagram illustrating an example of the structure of a head 150, and FIG. 14B is a partial enlarged diagram of same. Moreover, FIG. 14C is a plan view perspective diagram illustrating a further example of the structure of the head 150. FIG. 15 is a cross-sectional diagram (a cross-sectional diagram along line 15-15 in FIGS. 14A and 14B) illustrating the composition of one liquid ejection element (an ink chamber unit corresponding to one nozzle 151).

The nozzle pitch in the head 150 should be minimized in order to maximize the density of the dots formed on the surface of the recording paper 116. As illustrated in FIGS. 14A and 14B, the head 150 according to the present embodiment has a structure in which a plurality of ink chamber units (liquid ejection elements) 153, each comprising a nozzle 151 forming an ink droplet ejection hole, a pressure chamber 152 corresponding to the nozzle 151, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

The mode of forming one or more nozzle rows through a length corresponding to the entire width of the recording paper 116 in a direction substantially perpendicular to the paper conveyance direction is not limited to the example described above. For example, instead of the configuration in FIG. 14A, as illustrated in FIG. 14C, a line head having nozzle rows of a length corresponding to the entire width of the recording paper 116 can be formed by arranging and combining, in a staggered matrix, short head modules 150' having a plurality of nozzles 151 arrayed in a two-dimensional fashion.

As illustrated in FIGS. 14A and 14B, the planar shape of a pressure chamber 152 provided corresponding to each nozzle 151 is substantially a square shape, and an outlet port to the nozzle 151 is provided at one of the ends of a diagonal line of the planar shape, while an inlet port (supply port) 154 for supplying ink is provided at the other end thereof. The shape of the pressure chamber 152 is not limited to that of the present example and various modes are possible in which the planar shape is a quadrilateral shape (diamond shape, rectangular shape, or the like), a pentagonal shape, a hexagonal shape, or other polygonal shapes, or a circular shape, elliptical shape, or the like.

As illustrated in FIG. 15, each pressure chamber 152 is connected to a common flow channel 155 via a supply port 154. The common flow channel 155 is connected to an ink tank (not illustrated), which is a base tank that supplies ink, and the ink supplied from the ink tank is delivered through the common flow channel 155 to the pressure chambers 152.

An actuator 158 provided with an individual electrode 157 is bonded to a pressure plate (a diaphragm that also serves as a common electrode) 156 which forms the surface of one portion (in FIG. 15, the ceiling) of the pressure chambers 152. When a drive voltage is applied to the individual electrode 157 and the common electrode, the actuator 158 deforms, thereby changing the volume of the pressure chamber 152. This causes a pressure change which results in ink being ejected from the nozzle 151. For the actuators 158, it is possible to suitably adopt a piezoelectric element using a piezoelectric body, such as lead zirconate titanate, barium titanate, or the like. When the displacement of the actuator 158 returns to its original position after ejecting ink, the pressure chamber 152 is replenished with new ink from the common flow channel 155, via the supply port 154.

In the present embodiment, each recording element includes a common electrode 156, an individual electrode 157, an actuator 158 and a nozzle 151.

Figure 16:
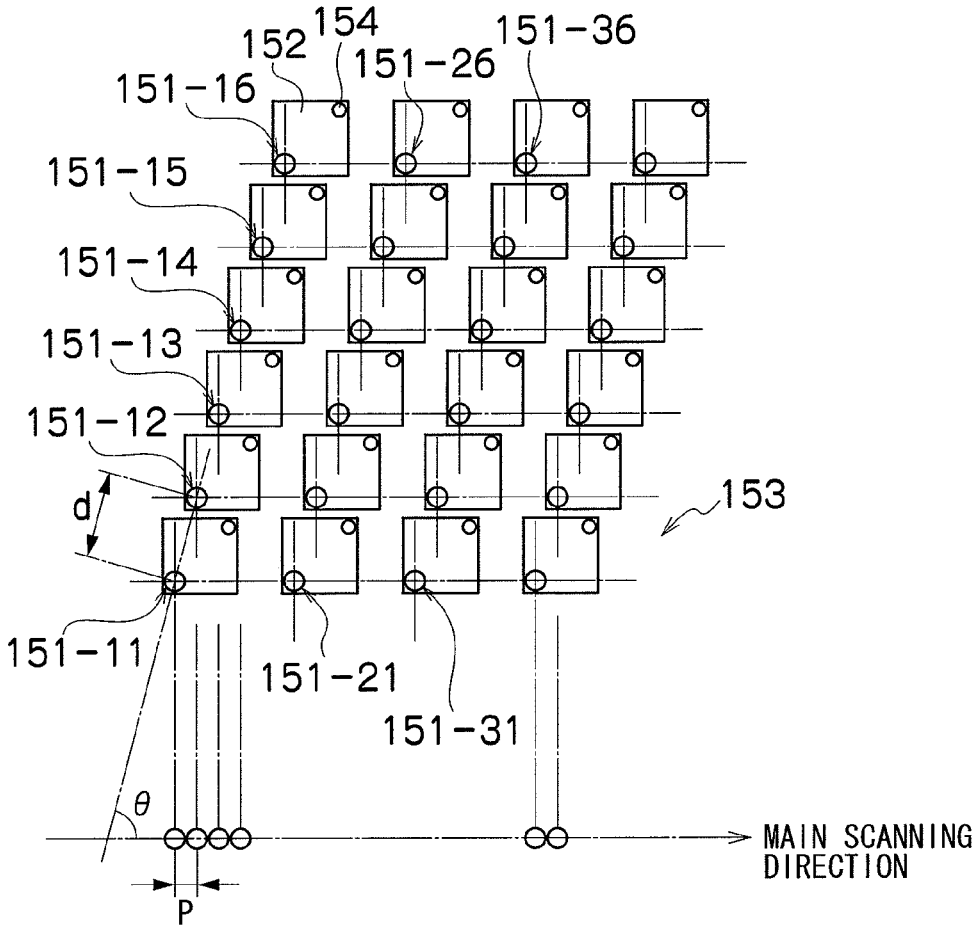
FIG. 16 is an enlarged view illustrating a nozzle configuration of the head shown in FIG. 14A.

As illustrated in FIG. 16, the high-density nozzle head according to the present embodiment is achieved by arranging a plurality of ink chamber units 153 having the above-described structure in a lattice fashion based on a fixed arrangement pattern, in a row direction which coincides with the main scanning direction, and a column direction which is inclined at a fixed angle of $\theta$ with respect to the main scanning direction, rather than being perpendicular to the main scanning direction.

More specifically, by adopting a structure in which a plurality of ink chamber units 153 are arranged at a uniform pitched in line with a direction forming an angle of $\theta$ with respect to the main scanning direction, the pitch P of the nozzles projected so as to align in the main scanning direction is $d \times \cos\theta$, and hence the nozzles 151 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch in one nozzle row.

More specifically, in a full-line head comprising rows of nozzles of a length corresponding to the entire width of the printable area, "main scanning" is defined as printing one line (a line formed of a row of dots, or a line formed of a plurality of rows of dots) in the breadthways direction of the paper (the direction perpendicular to the conveyance direction of the paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 151 arranged in a matrix such as that illustrated in FIG. 16 are driven, it is desirable that main scanning is performed in accordance with (3) described above. In other words, one line is printed in the breadthways direction of the recording paper 116 by taking the nozzles 151-11, 151-12, 151-13, 151-14, 151-15, 151-16 as one block (and taking the nozzles 151-21, . . . , 151-26, as one block, the nozzles 151-31, . . . , 151-36 as one block, and so on) and sequentially driving the nozzles 151-11, 151-12, . . . , 151-16 in accordance with the conveyance speed of the recording paper 116.

On the other hand, "sub-scanning" is defined as the action of repeatedly perform printing of one line (a line formed of a row of dots, or a line formed of a plurality of rows of dots) formed by the main scanning action, while moving the full-line head and the paper relatively to each other.

The direction indicated by one line (or the lengthwise direction of a band-shaped region) recorded by the main scanning as described above is called the "main scanning direction", and the direction in which the sub-scanning is performed, is called the "sub-scanning direction". In other words, in the present embodiment, the conveyance direction of the recording paper 116 is called the sub-scanning direction and the direction perpendicular to same is called the main scanning direction.

In implementing the present embodiment, the arrangement of the nozzles is not limited to that of the example illustrated. Moreover, in the present embodiment, a method is employed wherein an ink droplet is ejected by means of the deformation of an actuator 158, which is, typically, a piezoelectric element, but in implementing the present embodiment, there are no particular restrictions on the method used for ejecting ink, and instead of a piezo jet method, it is also possible to apply various other types of methods, such as a thermal jet method, wherein the ink is heated and bubbles are caused to form therein, by means of a heat generating body, such as a heater, ink droplets being ejected by means of the pressure of these bubbles.

Configuration of Control System

Figure 17:
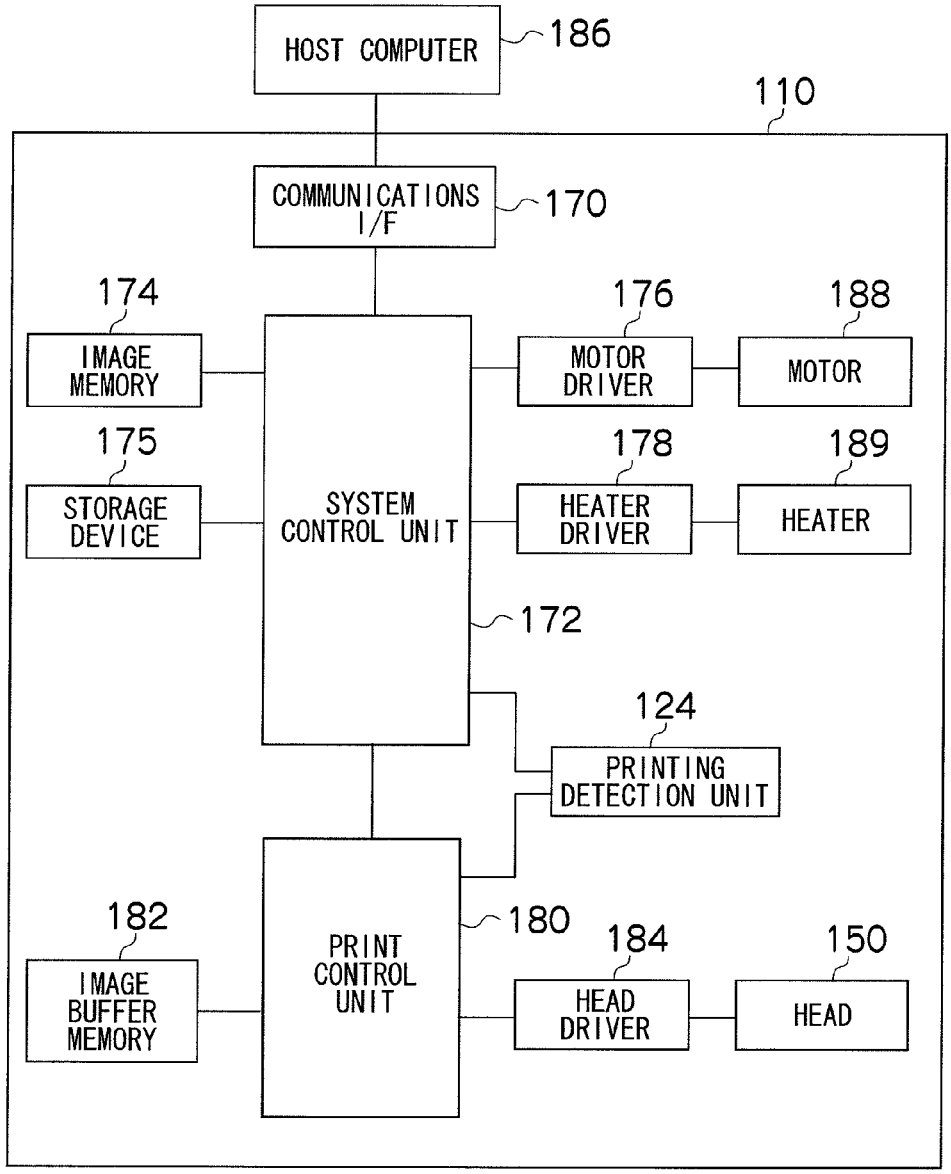
FIG. 17 is a principal block diagram illustrating a system configuration of an inkjet recording apparatus.

FIG. 17 is a block diagram illustrating the control system of the inkjet recording apparatus 110.

As illustrated in FIG. 17, the inkjet recording apparatus 110 comprises a communications interface 170, a system controller 172, an image memory 174, a storage device 175, a motor driver 176, a heater driver 178, a print controller 180, an image buffer memory 182, a head driver 184, and the like.

The communications interface 170 is an interface unit (image input device) for receiving image data sent from a host computer 186. A serial interface such as USB (Universal Serial Bus), IEEE1394, Ethernet (registered trademark), wireless network, or a parallel interface such as a Centronics interface may be used as the communications interface 170. A buffer memory (not illustrated) may be mounted in this portion in order to increase the communication speed.

The image data sent from the host computer 186 is received by the inkjet recording apparatus 110 through the communications interface 170, and is temporarily stored in the image memory 174. The image memory 174 is a storage device for storing images inputted through the communications interface 170, and data is written and read to and from the memory 174 through the system controller 172. The image memory 174 is not limited to a memory composed of semiconductor elements, and a hard disk drive or another magnetic medium may be used.

The system controller 172 is constituted by a central processing unit (CPU) and peripheral circuits thereof, and the like, and functions as a control device which controls the whole of the inkjet recording apparatus 110 in accordance with prescribed programs, as well as functioning as a calculation device which carries out various calculations. In other words, the system controller 172 controls the various units, such as the communications interface 170, the image memory 174, the motor driver 176, the heater driver 178, and the like, and controls communications with the host computer 186 as well as controlling the reading and writing of data to the image memory 174 and the storage device 175, and furthermore, it also generates driving control signals for controlling the motor 188 of the conveyance system and the heater 189.

The storage device 175 stores a program which is executed by the CPU of the system controller 172 and various data required for control purposes (including data relating to a test chart for ejection failure determination and a test chart for density measurement), and the like. The storage device 175 may be a non-rewriteable storage device such as ROM, or a rewriteable storage device, such as an EEPROM.

The image memory 174 is used as a temporary storage region for the image data, and it is also used as a program development region and a calculation work region for the CPU.

The motor driver (drive circuit) 176 drives the motors 188 of the conveyance system in accordance with commands from the system controller 172. The heater driver 178 drives the heaters 189 of the post-drying unit 142 and the like in accordance with commands from the system controller 172.

The print controller 180 is a control unit which functions as a signal processing device for performing various treatment processes, corrections, and the like, in accordance with the control implemented by the system controller 172, in order to generate a signal for controlling droplet ejection from the image data (multiple-value input image data) in the image memory 174, as well as functioning as a drive control device which controls the ejection driving of the head 150 by supplying the ink ejection data thus generated to the head driver 184.

The image buffer memory 182 is provided in the print controller 180, and image data, parameters, and other data are temporarily stored in the image buffer memory 182 when image data is processed in the print controller 180. FIG. 17 illustrates a mode in which the image buffer memory 182 is attached to the print controller 180; however, the image memory 174 or storage device 175 may also serve as the image buffer memory 182. Also possible is a mode in which the print controller 180 and the system controller 172 are integrated to form a single processor.

In other words, the print controller 180 performs processing for converting the input RGB image data into dot data for the four colors of K, C, M and Y. The dot data generated by the print controller 180 in this way is stored in the image buffer memory 182. This dot data of the respective colors is converted into CMYK droplet ejection data for ejecting ink from the nozzles of the head 150, thereby establishing the ink ejection data to be printed.

The head driver 184 outputs a drive control signal for driving the actuators 158 corresponding to the nozzles 151 of the head 150 in accordance with the print contents, on the basis of the ink ejection data and the drive waveform signals supplied by the print controller 180. A feedback control system for maintaining constant drive conditions in the head may be included in the head driver 184.

By supplying the drive control signal output by the head driver 184 to the head 150 in this way, ink is ejected from the corresponding nozzles 151. By controlling ink ejection from the printing head 150 in synchronization with the conveyance speed of the recording paper 116, an image is formed on the recording paper 116.

As described above, the ejection volume and the ejection timing of the ink droplets from the respective nozzles are controlled via the head driver 184, on the basis of the ink ejection data and the drive control signal waveform generated by implementing prescribed signal processing in the print controller 180. By this means, desired dot size and dot positions can be achieved.

As illustrated in FIG. 12, the print determination unit 124 is a block including an image sensor which reads in the image printed onto the recording medium 116, performs required signal processing operations, and the like, and determines the print situation (presence/absence of ejection, variation in droplet ejection, optical density, and the like), these determination results being supplied to the print controller 180 and the system controller 172.

The print controller 180 implements various corrections with respect to the head 150, on the basis of the information obtained from the print determination unit 124, according to requirements, and it implements control for carrying out cleaning operations (nozzle restoring operations), such as preliminary ejection, suctioning, or wiping, as and when necessary.

Control System for Correction Processing

Figure 18:
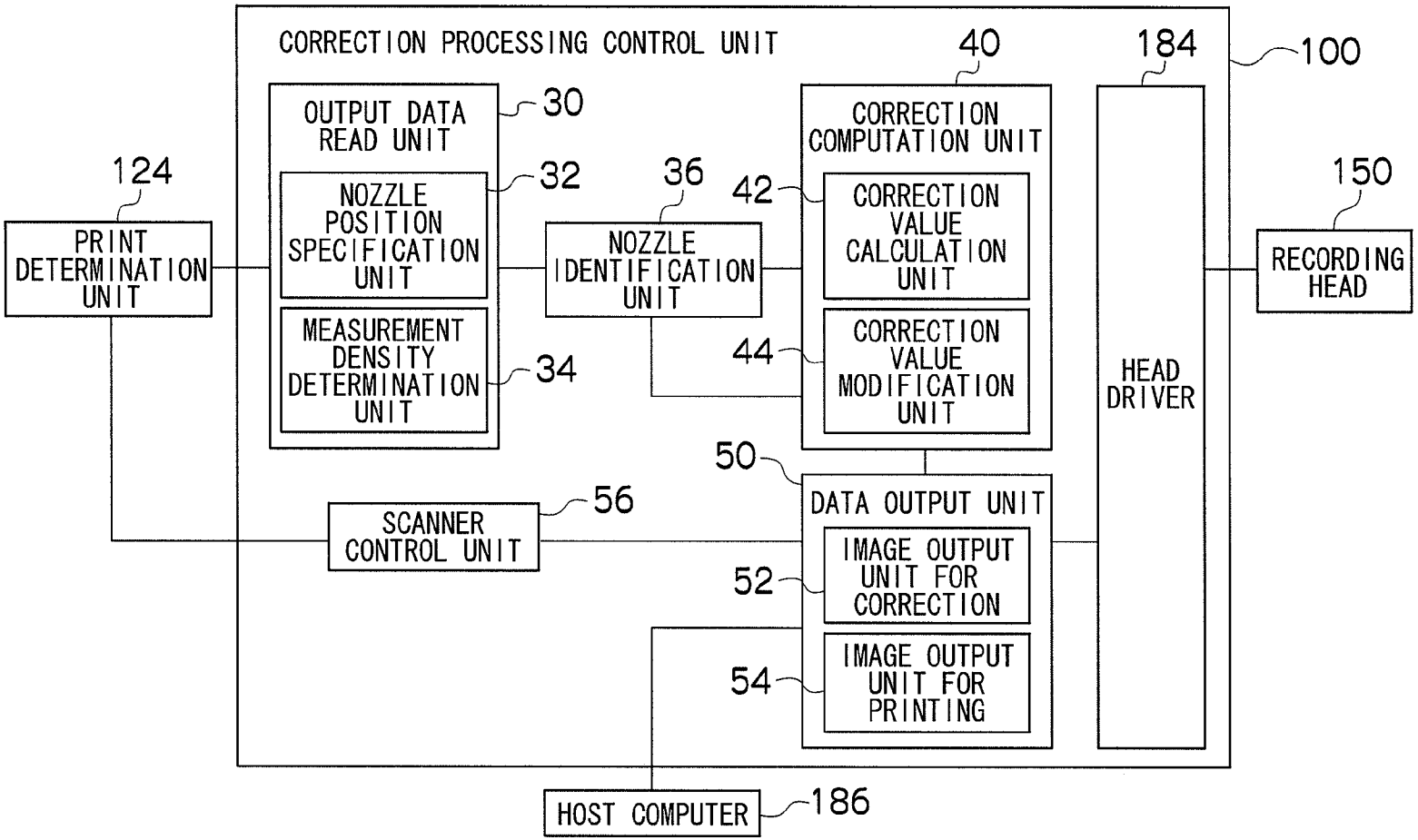
FIG. 18 is a functional block diagram illustrating a control configuration relating to correction processing.

A control system related to the correction processing is described below with reference to FIG. 18. FIG. 18 is a functional block diagram illustrating a control system related to the correction processing The correction processing control unit 100 shown in FIG. 18 is a unit which controls the aforementioned correction processing. This unit can be achieved by the system controller 172, print control unit 180, image memory 174, storage device 175, image buffer memory 182 shown in FIG. 17, and other devices. The below-described components included in the correction processing control unit 100 are represented by functional configurations, and can be realized by these hardware devices individually or in assemblies of a plurality thereof.

The correction processing control unit 100 includes an output data read unit 30, a nozzle identification unit 36, a correction computation unit 40, a scanner control unit 56, and the head driver 184. The output data read unit 30 includes a nozzle position specification unit 32 and a measurement density determination unit 34. The correction computation unit 40 includes a correction value calculation unit 42 and a correction value modification unit 44. The data output unit 50 includes an image output unit 52 for correction and an image output unit 54 for printing.

The print detection unit 124 functions as a density information acquisition device that acquires output density data (image read data) of each recording element by scanning a test chart (see FIG. 3) indicating the recording density formed for each recording element. The print detection unit 124 transmits the acquired image read data of the test chart to the output data read unit 30.

The output data read unit 30 functions as a density information acquisition device that acquires output density data indicating the recording density for each recording element on the basis of the image read data of the test chart transmitted from the print detection unit 124. The output data read unit 30 includes the nozzle position specification unit 32 that obtains the position of the corresponding nozzle from the measurement position in the test chart, and the measurement density determination unit 34 that detects the ink output density in the measurement position in the test chart.

The nozzle identification unit 36 functions as a characteristic computation device that obtains ejection information (recording information) for each recording element from the output density data acquired by the output data read unit 30 on the basis of the test chart. More specifically, the nozzle identification unit 36 obtains ejection information (test characteristic curve $G_t$) of each nozzle on the basis of output density data of each recording element transmitted from the output data read unit 30 and input image data for test chart output transmitted from the data output unit 50.

The nozzle identification unit 36 also functions as a characteristic storage device that stores characteristic information (appropriate characteristic curve $G_a$) in a normal state of the recording elements that is determined in advance, and also as a comparison device that compares the output density data of ejection information of the recording elements (including the recording elements that can perform recording on the recording medium) and the output density data of the stored characteristic information for each recording element. The nozzle identification unit 36 determines whether the target recording element is a normal nozzle or an abnormal density nozzle on the basis of the comparison result and can determine, for example as shown in FIG. 7, whether the target recording element is a normal nozzle or an abnormal density nozzle on the basis of the comparison result of the output density data ($G_t$) of ejection information and the predetermined critical density data $D_c$ based on the characteristic information. Thus, the nozzle identification unit 36 identifies whether the target recording element is a normal nozzle or an abnormal density nozzle according to whether the output density data of ejection information are included in a predetermined range based on the characteristic information.

The correction value calculation unit 42 of the correction computation unit 40 functions as a density correction value calculation device that calculates the correction value for recording control for each recording element on the basis of the comparison result of the ejection information (recording information) and the characteristic information in the nozzle identification unit 36.

More specifically, the correction value calculation unit 42 calculates the correction value as a difference in the input image data value such that the recording density data represented by the output density data of characteristic information (appropriate characteristic curve $G_a$) and the output density data of recording information (test characteristic curve $G_t$) match. Further, the correction value modification unit 44 of the correction computation unit 40 functions as a density correction value modification device that modifies the correction value for recording control of the peripheral recording elements when there is a detected recording element (abnormal density nozzle and corresponding drive element thereof) for which the ejection information is determined to fulfill the predetermined condition with respect to the characteristic information on the basis of the comparison result obtained in the nozzle identification unit 36. In this case, the correction value of the peripheral recording element is modified on the basis of the ejection information (recording information) of the detected recording element and the characteristic information of the detected recording element so as to compensate the recording density of the detected recording element. The peripheral recording element is a recording element (nozzle and the like) that records an ink dot on the periphery of the ink dot recording position on the recording medium produced by the detected recording element, and the detected recording element and the peripheral recording element are not necessarily arranged adjacently in the recording head. The ejection information and characteristic information are sent from the nozzle identification unit 36 to the correction computation unit 40.

"The case in which the predetermined condition is determined to be fulfilled" as used hereinabove relates to a case in which it is determined that the appropriate recording density derived from the characteristic information (appropriate characteristic curve $G_a$) cannot be outputted despite the correction (shading correction processing) for recording control conducted on the basis, for example, of recording information (test characteristic curve GO. For example, the case in which the output density data of the recording information (test characteristic curve $G_t$) of the abnormal density nozzle (detected recording element) does not exceed the predetermined critical density value $D_c$ established on the basis of the characteristic information (appropriate characteristic curve $G_a$) of the abnormal density nozzle, as shown in (II) of FIG. 7, can be also included in "the case in which the predetermined condition is determined to be fulfilled".

The correction value modification performed in the correction value modification unit 44 modifies the correction value for recording control of peripheral recording elements on the basis of a difference (Δ) between the output density data ($G_m$) of the abnormal density nozzle (detected recording element) after the correction based on the correction value calculated by the correction value calculation unit 42 and the output density data of characteristic information (appropriate characteristic curve $G_a$) relating to the abnormal density nozzle. In the above-described embodiment, a case is explained in which the modification value is Δ/2, but this modification value can be appropriately determined on the basis of mutual arrangement of the peripheral nozzles and the target nozzle (abnormal density nozzle) or the nozzle ejection performance.

The data output unit 50 functions as an image correction device that corrects for each recording element the data of an image outputted by the plurality of recording elements onto the recording medium on the basis of the correction value calculated by the correction value calculation unit 42 of the correction computation unit 40 and the correction value modified by the correction value modification unit 44 of the correction computation unit 40. The image output unit 52 for correction of the data output unit 50 outputs input image data for forming a test chart on the recording medium. The image output unit 54 for printing of the data output unit 50 outputs input image data for forming the desired image on the recording medium.

The image output unit 52 for correction sends input image data for test chart formation to the head driver 184 for each printing of the desired image or on the basis of an indication from the user issued via the host computer 186. When the test chart is recorded, the scan control unit 56 that controls the print detection unit 124 is notified of the record of the test chart from the data output unit 50, and the scan control unit 56 may control, on the basis of this notification, the print detection unit 124 so as to acquire a scan image of the test chart that is recorded. The input image data for test chart formation are also sent to the nozzle identification unit 36 and used to determine whether the target nozzle is a normal nozzle or an abnormal density nozzle in the nozzle identification unit 36.

The image output unit 54 for printing performs for each nozzle the above-described correction processing based on the correction information transmitted from the correction computation unit 40 with respect to the input image data relating to the recording of the desired image transmitted from the host computer 186, and outputs the input image data subjected to such correction to the head driver 184.

The head driver 184 sends a drive control signal based on the input image data transmitted from the data output unit 50 to the head 150 (actuator 158 and the like) and various devices related to the driving of the head 150, and an image based on the input image data sent from the data output unit 50 is formed on the recording medium. The test chart for correction determination or the print image desired by the user is thus recorded on the recording medium.

In the present embodiment, the print detection unit (scanner) 124 is provided inside the inkjet recording unit 110, but the print detection unit for reading the test chart may be also provided separately from the inkjet recording unit 110.

The processing of input image data may be also performed by an image processing device separate from the inkjet recording unit 110.

Further, in the above-described embodiment, the case is explained in which the present invention is applied to an inkjet recording apparatus, but the application range of the present invention is not limited thereto. Thus, the present invention can be also applied to image recording apparatuses of systems other than that of the inkjet recording apparatus, for example, a thermal transfer recording device equipped with a recording head using a thermal element as a recording element, a LED electrophotographic printer equipped with a recording head using a LED element as a recording element, and a printer of a silver halide photographic system having a LED line exposure head.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image recording apparatus comprising:

a recording head having a plurality of recording elements;

a conveying device which conveys at least one of the recording head and a recording medium to cause relative movement between the recording head and the recording medium;

a density information acquisition device which acquires output density data indicating a recording density of each of the plurality of recording elements;

a characteristic computation device which obtains recording information of each of the plurality of recording elements from the output density data acquired by the density information acquisition device;

a characteristic storage device which stores characteristic information in an appropriate state of the plurality of recording elements that is set in advance;

a comparison device which compares, for each recording element that is able to perform recording on the recording medium, the recording information with the characteristic information stored in the characteristic storage device;

a density correction value calculation device which calculates, for each of the plurality of recording elements, a correction value for recording control according to a comparison result of the recording information and the characteristic information obtained by the comparison device;

a density correction value modification device which performs modification of the correction value for recording control of a peripheral recording element that performs the recording on a periphery of a recording position on the recording medium performed by a detected recording element, from among the plurality of recording elements, for which the recording information is determined to fulfill a predetermined condition with respect to the characteristic information according to the comparison result, the modification being performed according to the recording information and the characteristic information of the detected recording element so as to compensate the recording density of the detected recording element; and an image correction device which performs, for each of the plurality of recording elements, correction of data of an image outputted by the plurality of recording elements onto the recording medium, according to the correction value calculated by the density correction value calculation device and the correction value modified by the density correction value modification device.

2. The image recording apparatus as defined in claim 1, wherein a case in which the predetermined condition is determined to be fulfilled is a case in which it is determined that an appropriate recording density derived from the characteristic information cannot be outputted even if correction for the recording control is performed according to the recording information.

3. The image recording apparatus as defined in claim 1, wherein:

the recording information and the characteristic information are based on input density data inputted to the plurality of recording elements and the output density data of the plurality of recording elements; and the comparison device compares, for each of the plurality of recording elements, the output density data with respect to the input density data of the recording information, to the output density data with respect to the input density data of the characteristic information.

4. The image recording apparatus as defined in claim 3, wherein a case in which the predetermined condition is determined to be fulfilled is a case in which the output density data of the recording information of the detected recording element do not exceed a predetermined critical density value that is established according to the characteristic information of the detected recording element.

5. The image recording apparatus as defined in claim 3, wherein the density correction value calculation device calculates, for each of the plurality of recording elements, the correction value according to a difference between the recording density indicated by the output density data of the characteristic information and the recording density indicated by the output density data of the recording information.

6. The image recording apparatus as defined in claim 3, wherein the density correction value modification device modifies the correction value for recording control of the peripheral recording element according to a difference between the output density data of the detected recording element after the correction has been performed according to the correction value calculated by the density correction value calculation device, and the output density data of the characteristic information of the detected recording element.

7. The image recording apparatus as defined in claim 1, wherein the peripheral recording elements records the image on the recording medium in opposing positions between which a position of the recording performed by the detected recording element is situated.

8. The image recording apparatus as defined in claim 1, wherein the plurality of recording elements are disposed in the recording head in a range corresponding to entire width of a recording range of the recording medium.

9. The image recording apparatus as defined in claim 1, wherein the recording head records the image on a predetermined recording range of the recording medium by one cycle of the relative movement.

10. An image recording method controlling a plurality of recording elements to record an image, the image recording method comprising:

a density information acquisition step of acquiring output density data indicating a recording density of each of the plurality of recording elements;

a characteristic computation step of obtaining recording information of each of the plurality of recording elements from the output density data;

a comparison step of performing, for each recording element that is able to perform recording on the recording medium, comparison of the recording information with characteristic information in an appropriate state of the plurality of recording elements that is set in advance;

a density correction value calculation step of calculating, for each of the plurality of recording elements, a correction value for recording control according to result of the comparison of the recording information and the characteristic information;

a density correction value modification step of performing modification of the correction value for recording control of a peripheral recording element that performs recording on a periphery of a recording position on the recording medium performed by a detected recording element, from among the plurality of recording elements, for which the recording information is determined to fulfill a predetermined condition with respect to the characteristic information according to the result of the comparison, the modification being performed according to the recording information and the characteristic information of the detected recording element so as to compensate the recording density of the detected recording element; and an image correction step of correcting, for each of the plurality of recording elements, data of the image outputted by the plurality of recording elements onto the recording medium, according to the correction value calculated in the density correction value calculation step and the correction value modified in the density correction value modification step.

* * * * *